US005672424A

United States Patent [19]

Malhotra et al.

[11] Patent Number: 5,672,424

[45] Date of Patent: Sep. 30, 1997

[54] INK JET TRANSPARENCIES

[75] Inventors: Shadi L. Malhotra; Kirit N. Naik, both of Mississauga; David N. MacKinnon, Etobicoke, all of Canada

[73] Assignee: Xerox Corporation, Stamford, Conn.

[21] Appl. No.: 658,288

[22] Filed: Jun. 3, 1996

[51] Int. Cl.[6] ..... B41M 5/00; B41J 2/01

[52] U.S. Cl. ..... 428/325; 428/195; 428/327; 428/328; 428/329; 428/330; 428/331; 428/412; 428/478.2; 428/480; 428/500; 428/520; 428/524; 428/532; 428/913

[58] Field of Search ..... 347/105; 428/195, 428/325, 327–331, 412, 478.2, 480, 500, 520, 524, 532, 913

[56] References Cited

U.S. PATENT DOCUMENTS

| | | | |
|---|---|---|---|
| 4,956,225 | 9/1990 | Malhotra | 428/216 |
| 4,997,697 | 3/1991 | Malhotra | 428/195 |
| 5,006,407 | 4/1991 | Malhotra | 428/336 |
| 5,118,570 | 6/1992 | Malhotra | 428/474.4 |
| 5,202,205 | 4/1993 | Malhotra | 430/17 |
| 5,212,008 | 5/1993 | Malhotra et al. | 428/216 |

*Primary Examiner*—Bruce H. Hess
*Attorney, Agent, or Firm*—E. O. Palazzo

[57] ABSTRACT

A transparency comprised of a supporting substrate, thereover a first coating layer comprised of an anionic layer that binds well with the substrate; and a second cationic layer situated on the top of the first anionic layer that binds with the anionic layer and comprised of cationic quaternary monomers and polymers thereof and a lightfastness inducing agent; and a third ink receiving layer situated on the top of the second cationic layer and comprised of block copolymers and graft polymers, a biocide and a filler; which transparency possesses a haze value of from about 0.5 to about 10 and a lightfastness value of from about 95 to about 98.

21 Claims, No Drawings

INK JET TRANSPARENCIES

BACKGROUND OF THE INVENTION

The present invention is directed to transparencies, and more specifically, to low haze lightfast, waterfast ink jet transparencies with improved ink absorption and ink spreading when used in combination with slow drying inks of one color and fast drying inks of another color. In embodiments of the present invention, the transparencies are comprised of ink receiving layers comprised of block copolymers and graft copolymers with, for example, at least two components where one copolymer component is more compatible with the fast drying colored inks and the second copolymer component is more compatible with the slow drying black inks. More compatible refers, for example, to inks with excellent ink spreading, high optical density, minimal intercolor bleed, rapid drying times, and wherein images of excellent resolution can be generated. In embodiments of the present invention, the transparencies are comprised of a supporting substrate, such as MYLAR®, and thereover three coatings, a first coating layer which comprises an anionic hydrophilic binder or mixtures thereof, for example from two to about four binders; a second, dye immobilizing light resistant coating layer situated in a manner that the first coating layer is between the second, dye immobilizing light resistant coating layer and the substrate, the second, dye immobilizing light resistant coating layer comprising a blend of a cationic component monomer like tetra methyl ammonium bromide, or polymeric like quaternary ammonium block copolymers containing amide units and alkyleneoxide units, such as Mirapol AZ-1 obtained from Miranol Incorporated, and which are capable of complexing with the anionic hydrophilic binder, and a lightfastness inducing agent, and or mixtures thereof, and a third ink-receiving layer situated on the top of the dye immobilizing light resistant coating layer; said third, ink-receiving layer comprising a block copolymer, or scrambled copolymer, when a blend of two homopolymers such as A and B is dissolved in a solvent and subjected to ultrasonic energy for a period of time, initially there is a breakdown of these polymers and the chain length of these polymers is shortened by the shear force of ultrasound. The resulting solution has shorter polymer chains with free radicals on their ends. These free radical containing chains of one polymer can either recombine with themselves or combine with chains of the other polymer; one can have combinations of AA Type, AB Type, BB Type, or BA Type. As the ultrasonic process proceeds, one can obtain other combinations of ABA Type, ABB Type, BBA Type, BBB Type, BAA Type, BAB Type, AA-BB Type, AA-AB Type, BB-AA Type, or BA-BB Type. Once the reaction is completed, the final solution can contain a number of combinations yielding copolymers which are neither perfect block copolymers nor perfect graft copolymers, but are somewhere in between. A procedure used for synthesizing block copolymers using ultrasound is described in detail in *J. Macromol. Sci. Chem* A18(5) 783(1982), S. L. Malhotra et al., the disclosure of which is totally incorporated herein by reference, such as methyl cellulose (MC)-polyacrylamide (PAm) copolymer with a methyl cellulose content of 51.7 percent by weight, and a viscosity average molecular weight of $\overline{M}_v=6.0\times10^4$, hydroxypropyl cellulose (HPC)-polyethylene oxide (PEO) copolymer with a hydroxypropyl cellulose content of 52.3 percent by weight, and a viscosity average molecular weight of $\overline{M}_v=1.8\times10^5$, methyl cellulose (MC)-polyacrylic acid (PAA) copolymer with a methyl cellulose content of 53.3 percent by weight, and a viscosity average molecular weight of $\overline{M}_v=5.5\times10^4$, hydroxypropyl methyl cellulose (HPMC)-polyacrylamide (PAm)polyvinylalcohol (PVA) terpolymer with an hydroxypropyl methyl cellulose content of 33.3 percent by weight, polyacrylamide content of 31.4 percent by weight, polyvinylalcohol content of 35.3 percent by weight, and a viscosity average molecular weight of $\overline{M}_v=8.0\times10^4$, synthesized via ultrasonic modifications of homopolymers and comprised of a minimum of two components, and a maximum of five components and preferably a maximum of three components where one component is more compatible with the fast drying colored inks, such as nonionic polysaccharides, vinyl polymers, and the like, and the second component is more compatible with the slow drying black inks and is selected from the group consisting of alkylene oxide polymers, formaldehyde resins, maleic anhydride and maleic acid containing polymers, acrylic polymers, imine polymers, and or mixtures thereof; a filler and a biocide, and preferably wherein three coatings are present on each surface of the supporting substrate.

With the transparencies of the present invention, there are enabled a number of advantages, including the important advantage of low haze, that is, for example, wherein the transparencies permit greater than 95 percent of the light to be transmitted therethrough in embodiments, and which transparencies possess excellent lightfastness and waterfastness characteristics. The transparencies of the present invention can be selected for ink jet methods and apparatus, which employ slow drying inks of one color and fast drying inks of another color in order to reduce intercolor bleed. Different solvent vehicles may be used to generate slow drying inks of one color and fast drying inks of another color which necessitates developing transparencies with special surfaces to accommodate these variable ink compositions such as those of the present application.

U.S. Pat. No. 5,118,570 and U.S. Pat. No. 5,006,407, the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 4,526,847 discloses a transparency for the formation of an adherent electrostatic image thereon which includes a polyester resin film sheet having an image-receiving coating of nitrocellulose, a plasticizer, a particulate material, and preferably an antistatic agent. The coating is applied to the film sheet from a solvent mixture of an aliphatic ester or an aliphatic ketone, and an aliphatic alcohol.

U.S. Pat. No. 3,561,337 discloses a sheet material having a transparent backing coated with a layer containing a polymeric binder and particles of solid material which is insoluble in the binder. The refractive index of the solid material varies, for example, from that of the binder by at most ±0.6. The surface of the layer is ink receptive and by printing on that surface, a transparency is obtained.

U.S. Pat. No. 4,956,225 discloses a transparency suitable for electrographic and xerographic imaging which comprises a polymeric substrate with a toner receptive coating on one surface thereof comprising blends selected from the group consisting of poly(ethylene oxide) and carboxymethyl cellulose; poly(ethylene oxide), carboxymethyl cellulose, and hydroxypropyl cellulose; poly(ethylene oxide) and vinylidene fluoride/hexafluoropropylene copolymer; poly (chloroprene) and poly(alpha-methylstyrene); poly (caprolactone) and poly(alpha-methylstyrene); poly(vinyl isobutyl ether) and poly(alpha-methylstyrene); poly (caprolactone) and poly(p-isopropyl alpha-methylstyrene); blends of poly(1,4-butylene adipate) and poly(alpha-methylstyrene); chlorinated poly(propylene) and poly (alpha-methylstyrene); chlorinated poly(ethylene) and poly (alpha-methylstyrene); and chlorinated rubber and poly (alpha-methylstyrene).

U.S. Pat. No. 4,997,697 discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205, the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds, both with polymers containing oxyalkylene segments.

Copending application U.S. Ser. No. 208,317, the disclosure of which is totally incorporated herein by reference, discloses a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Also disclosed is a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

Copending application U.S. Ser. No. 196,607, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 196,605, the disclosure of which is totally incorporated herein by reference, discloses a recording sheet which comprises a substrate, an image receiving coating, and a biocide.

U.S. Pat. No. 5,624,743, the disclosure of which is totally incorporated herein by reference, discloses a transparency comprised of a supporting substrate, thereover a first coating layer comprised of a binder having a glass transition temperature of less than about 55° C., a cellulosic viscosity modifier, a lightfastness inducing agent and a biocide; and a second ink-receiving coating layer comprised of a hydrophilic binder, an oxyalkylene containing compound, a dye mordant, an optional filler, and an optional biocide; and wherein the first coating is in contact with the substrate and is situated between the substrate and the second ink coating, and which transparency possesses a haze value of from about 1 to about 10 and a lightfastness value of from about 80 to about 95.

Copending application U.S. Ser. No. 08/657,134, filed concurrently herewith, the disclosure of which is totally incorporated herein by reference, discloses a transparency comprised of a supporting substrate, thereover a first coating layer comprised of an ink absorbing layer and a biocide; and a second ink spreading coating layer comprised of a hydrophilic vinyl binder, a dye mordant, a filler, an optional lightfastness inducing agent and an ink spot size increasing agent selected from the group consisting of hydroxy acids, amino acids and polycarboxyl acids; and wherein the first coating is in contact with the substrate and is situated between the substrate and the second ink coating; and which transparency possesses a haze value of from about 0.5 to about 10 and a lightfastness value of from about 95 to about 98.

Copending application U.S. Ser. No. 08/657,218, filed concurrently herewith, the disclosure of which is totally incorporated herein by reference, discloses a transparency comprised of a supporting substrate, and thereover two coatings, a first heat dissipating and fire resistant coating layer in contact with the substrate and wherein said first coating is comprised of a binder with a melting point in the range of from about 100° to about 275° C. and a heat dissipating fire retardant component, and a second ink receiving coating layer thereover comprising a blend of a binder polymer, a cationic component, a lightfastness inducing agent, a filler, a biocide, and an ink spreading fluoro compound containing from 1 to about 25 fluorine atoms and having a melting point of between about 50° to about 100° C.

The disclosures of each of the patents and applications recited herein are totally incorporated herein by reference in their entirety.

While the above transparencies are suitable for their intended purposes, a need remains for improved transparencies particularly suitable for use in ink jet and electrophotographic applications. In addition, a need remains for transparencies that can be used in printers that employ slow drying black inks and fast drying colored inks. In addition, a need remains for transparencies with excellent low haze characteristics, such as haze between from about 1 to about 10 and preferably between 1 to 4, and excellent lightfastness in the range of from about 80 to about 95 percent, a feature not easily obtained considering that the total thickness of the two layered coatings can range from 2 to 50 microns and average about 25 microns. There is also a need for improved waterfastness of images in the ink jet transparencies, and a need for transparencies wherein colors can be satisfactorily projected. A need also remains for transparencies which are particularly suitable for use in printing processes wherein the recorded transparencies are imaged with liquid inks and dried by exposure to microwave radiation. Further, there is a need for transparencies coated with a discontinuous, porous film. There is also a need for transparencies which, subsequent to being imaged with an aqueous ink, exhibit reduced curling. These and other needs are achievable with the transparencies of the present invention in embodiments thereof.

SUMMARY OF THE INVENTION

It is an object of the present invention to provide transparencies with many of the advantages illustrated herein.

It is another object of the present invention to provide transparencies particularly suitable for use in electrophotographic and ink jet applications.

It is another object of the present invention to provide transparencies particularly suitable for ink jet printers employing slow drying black inks and fast drying colored inks.

It is another object of the present invention to provide transparencies with waterfast and lightfast images.

It is yet another object of the present invention to provide transparencies with low haze characteristics, such as from about 1 to about 10, and wherein the color gamut is acceptable and does not substantially change.

Moreover, another object of the present invention is to provide transparencies with the combination of excellent lightfastness properties, such as from about 80 to about 95, and low haze characteristics, such as from about 1 to about 10 and preferably from about 1 to about 5, wherein the color gamut is acceptable and does not substantially change.

These and other objects of the present invention can be accomplished in embodiments thereof by providing transparencies with coatings thereover. More specifically, the transparencies of the present invention are comprised of a supporting substrate, a first coating layer thereover of an anionic polymer having excellent adhesion to the substrate, such as an acrylic emulsion Rhoplex TR-934, having a glass transition of minus 30° C. and available from Rhom and Hass Company, a second dye immobilizing light resistant coating layer situated so that the first coating layer is between the second dye immobilizing light resistant coating layer and the substrate, said second dye immobilizing light resistant coating layer comprising a blend of a cationic component monomeric or polymeric capable of complexing with the anionic hydrophilic binder and a lightfastness inducing agent, and/or mixtures thereof; a third ink-spreading layer situated on the top of the dye immobilizing light resistant coating layer, said third ink receiving layer comprising scrambled block or graft copolymers synthesized via ultrasonic modifications of homopolymers and made up of a minimum of two components, where one component is more compatible with the fast drying colored inks, such as nonionic polysaccharides, vinyl polymers, and the like, and the second component is more compatible with the slow drying black inks and is selected from the group consisting of alkyleneoxide polymers, formaldehyde resins, maleic anhydride and maleic acid containing polymers, acrylic polymers, imine polymers, and or mixtures thereof; a filler and a biocide. Furthermore, in situations where the lightfastness of images is desired to be greater than 95 percent, supplemental amounts of from about 1 to about 5 parts by weight of other lightfastness inducing acids may be incorporated in the ink receiving top layer. Additionally, to protect the coatings from bacterial degradation, appropriate biocides are incorporated in the coating compositions.

Examples of substrate materials include polyesters, including MYLAR™, polyethylene terephthalate available from E.I. DuPont de Nemours & Company, MELINEX™, polyethylene terephthalate available from Imperial Chemicals, Inc., CELANAR™, polyethylene terephthalate available from Celanese Corporation, polyethylene naphthalates, such as Kaladex PEN films, available from Imperial Chemical Industries, polycarbonates, such as LEXAN™, available from General Electric Company, polysulfones, such as those available from Union Carbide Corporation, polyether sulfones, such UDEL™, available from Union Carbide Corporation, cellulose triacetate, polyvinylchloride cellophane, polyvinyl fluoride, polyimides, and the like, with polyester, such as MYLAR™, being preferred in view of its availability and relatively low cost. The substrate can also be opaque, including opaque plastics, such as TESLIN™ available from PPG Industries, and filled polymers, available from ICI, with fillers such as oxides and sulfates.

The substrate, which preferably includes two coatings thereon, and two coatings thereunder in contact with the substrate, can be of any effective thickness. Typical thicknesses for the substrate are from about 50 to about 500 microns, and preferably from about 100 to about 125 microns, although the thickness may be outside these ranges.

The first layer coating composition comprises a binder, for example polyalkyl acrylate, where alkyl is methyl, ethyl, propyl and hexyl, such as the acrylic emulsion Rhoplex TR-934, with a glass transition of minus 30° C. and containing 55.5 percent of water and 44.5 percent of polyalkyl acrylate and available from Rhom and Hass Company, and which is present on the front side of the substrate of the multilayered transparency of the present invention in any effective thickness. Typically, the total thickness of this first coating layer is from about 0.1 to about 25 microns and preferably from about 0.5 to 10 microns, although the thickness can be outside of these ranges. In the first coating composition, binder or mixtures thereof can be present within the coating in any effective amount, typically the binder or mixtures thereof are present in amounts of from about 25 parts by weight to about 75 parts by weight of one binder and from about 75 parts by weight to about 25 parts by weight of the other.

The second layer coating composition situated on the top of the first ink absorbing layer comprises a blend of a cationic component monomeric or polymeric capable of complexing with the anionic hydrophilic binder and a lightfastness inducing agent, and/or mixtures thereof, is present on the top of the first anionic layer of the substrate of the multilayered transparency of the present invention in any effective thickness. Typically, the total thickness of this second coating layer is from about 0.1 to about 25 microns and preferably from about 0.5 to 10 microns, although the thickness can be outside of these ranges. In the second coating composition, or mixtures thereof, the cationic components can be present within the coating in any effective amount. Typically, the cationic components are present in amounts of from about 80 parts by weight to about 97 parts by weight although the amounts can be outside of this range. The lightfastness inducing components are present in amounts of from about 20 parts by weight to about 3 parts by weight although the amounts can be outside of this range.

The third layer coating composition situated on the top of the second cationic layer comprises scrambled block or graft copolymers, such as methyl cellulose (MC)-polyacrylamide (PAm) copolymer with a methyl cellulose content of 51.7 percent by weight and a viscosity average molecular weight of $\overline{M}_v=6.0\times10^4$, hydroxypropyl cellulose (HPC)-polyethylene oxide (PEO) copolymer with a hydroxypropyl cellulose content of 52.3 percent by weight and a viscosity average molecular weight $\overline{M}_v=1.8\times10^5$, methyl cellulose (MC)-polyacrylic acid (PAA) copolymer with a methyl cellulose content of 53.3 percent by weight and a viscosity average molecular weight of $\overline{M}_v=5.5\times10^4$, hydroxypropyl methyl cellulose (HPMC)-polyacrylamide (PAm)-polyvinylalcohol (PVA) terpolymer with an hydroxypropyl methylcellulose content of 33.3 percent by weight, polyacrylamide content of 31.4 percent by weight, polyvinylalcohol content of 35.3 percent by weight, and a viscosity average molecular weight of $\overline{M}_v=8.0\times10^4$ synthesized via ultrasonic modifications of homopolymers, and wherein in embodiments one component is more compatible with the fast drying colored inks, such as polysaccharides, vinyl polymers, and the like, and the second component is more compatible with the slow drying black inks and is selected from the group consisting of alkylene oxide polymers, formaldehyde resins, maleic anhydride and maleic acid containing polymers, acrylic polymers, imine polymers, and or mixtures thereof; a filler and a biocide, is present on the top of the second cationic layer, of the substrate of the multilayered transparency of the present invention in any effective thickness. Typically, the total thickness of this second coating layer is from about 0.1 to about 25 microns and preferably from about 0.5 to 10 microns, although the thickness can be outside of these ranges. In the third coating composition, or mixtures thereof, the block copolymer components can be present within the coating in any effective amount; typically the block copolymers are present in amounts of from about 90 parts by weight to about 98.9 parts by weight although the amounts can be outside of this range. The fillers are present in amounts of from about 5 parts by weight to about 1 part by weight although the amounts can be outside of this range. The biocides are present in amounts of from about 5 parts by weight to about 0.1 part by weight although the amounts can be outside of this range.

Embodiments of the present invention include a transparency comprised of a supporting substrate, and thereover three coatings, a first anionic binder polymer that adheres well to the substrate, such as acrylic emulsion polyalkyl acrylate, where alkyl is methyl, ethyl, propyl, butyl and hexyl such as the acrylic emulsion Rhoplex TR-934, having a glass transition of minus 30° C. and containing 55.5 percent of water and 44.5 percent of polyalkyl acrylate and available from Rhom and Hass Company, and wherein the anionic binder or mixtures thereof are present in amounts of from about 25 parts by weight to about 75 parts by weight of one binder and from about 75 parts by weight to about 25 parts by weight of the other binder; and a second cationic coating layer which comprises a blend of a monomeric cationic component, such as tetra methyl ammonium bromide (Aldrich 19,575-8), tetra methyl ammonium chloride (Aldrich T1,952-6), and tetra methyl ammonium iodide (Aldrich 23,594-6); or polymeric component, such as Mirapol AZ-1, available from Miranol, Incorporated, capable of complexing with the anionic hydrophilic binder and a lightfastness inducing agent, such as poly [N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company), 2-dodecyl-N-(2,2,6,6-tetramethyl-4-piperidinyl) succinimide (Cyasorb UV-3581, #41,317-8, available from Aldrich Chemical Company), 2-dodecyl-N-(1,2,2,6,6-pentamethyl-4-piperidinyl) succinimide (Cyasorb UV-3604, #41,318-6, available from Aldrich Chemical Company), and/or mixtures thereof, and a third ink receiving coating, which comprises a blend of a diblock copolymer such as methyl celluose-polyacrylamide, or hydroxypropyl cellulose-polyethylene oxide, methyl cellulose-polyacrylic acid or triblock copolymer of hydroxypropyl methyl celluose-polyacrylamide-polyvinyl alcohol with a filler, such as colloidal silica, and a biocide, such as cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as Slime-Trol RX-31, RX-32, RX-32P, RX-33, from Betz Paper Chem Inc.).

One embodiment of the present invention includes a transparency with a first layer coating in a thickness of 10 microns, and is comprised of 100 parts by weight of the acrylic emulsion Rhoplex TR-934 having a glass transition of minus 30° C. and available from Rhom and Hass Company, and a second 5 micron thick cationic layer comprised of 50 parts by weight of the polymeric Mirapol AZ-1, available from Miranol, Incorporated, 45 parts by weight of the monomeric cationic component tetra methyl ammonium bromide (Aldrich 19,575-8), 3 parts by weight of UV absorbing compound poly [N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2 parts by weight of an antioxidant compound 4,4'-methylene-bis(dibutyldithio carbamate), available as Vanlube 7723 from Vanderbilt Corporation, and a third ink receiving layer comprised of 95.9 parts by weight of the scrambled triblock copolymer of hydroxypropyl methyl celluose-polyacrylamide-polyvinyl alcohol prepared via ultrasonic degradation of a ternary mixture in water of hydroxypropyl methyl cellulose, polyvinyl alcohol and polyacrylamide, under inert conditions, as described in *Macromol. Sci. Chem.* A18(5) 783(1982), S. L. Malhotra et al., the disclosure of which is totally incorporated herein by reference, 0.1 part by weight of the filler colloidal silica and 4 parts by weight of the biocide cationic poly(oxyethylene (dimethylamino)-ethylene (dimethylamino) ethylene dichloride) (Busan 77, available from Buckman Laboratories Inc.). This transparency has a haze value of 2, and lightfast values of about 90 percent, and waterfastness of greater than 75 percent.

Examples of the first layer anionic polymers in contact with both lateral surfaces of the substrate include water dispersible polymers such as (A) latex polymers, polymers capable of forming a latex includes, for example, a polymer that forms in water or in an organic solvent, such as toluene, acetone, dichloromethane, or an aliphatic alcohol, and wherein typically the organic solvent is present in an amount of from about 10 to about 30 percent by weight; a stable colloidal system in which the dispersed phase is polymeric. Examples of suitable latex-forming polymers include rubber latex, such as NEOPRENE™ available from Serva Biochemicals, polyester latex, such as Eastman AQ 29D available from Eastman Chemical Company, vinyl chloride latex, such as Geon 352 from B.F. Goodrich Chemical Group, ethylene-vinyl chloride copolymer emulsions, such as Airflex ethylene-vinyl chloride from Air Products and Chemicals, polyvinyl acetate homopolymer emulsions, such as Vinac from Air Products and Chemicals, carboxylated vinyl acetate emulsion resins, such as Synthemul synthetic resin emulsions 40-502, 40-503, and 97-664 from Reichhold Chemicals Inc., and Polyco 2149, 2150, and 2171 from Rohm and Haas Company, vinyl acetate copolymer latex, such as 76 RES 7800 from Union Oil Chemicals Divisions, and Resyn 25-1103, Resyn 25-1109, Resyn 25-119, and Resyn 25-1189 from National Starch and Chemical Corporation, ethylene-vinyl acetate copolymer emulsions, such as Airflex ethylene-vinyl acetate from Air Products and Chemicals Inc., acrylic-vinyl acetate copolymer emulsions, such as Rhoplex AR-74 from Rohm and Haas Company, Synthemul 97-726 from Reichhold Chemicals Inc., Resyn 25-1140, 25-1141, 25-1142, and Resyn-6820 from National Starch and Chemical Corporation, vinyl acrylic terpolymer latex, such as 76 RES 3103 from Union Oil Chemical Division, and Resyn 25-1110 from National Starch and Chemical Corporation, acrylic emulsion latex, such as Rhoplex B-15J, Rhoplex P-376, Rhoplex TR-407, Rhoplex E-940, Rhoplex TR-934, Rhoplex TR-520, Rhoplex HA-24, and Rhoplex NW-1825 from Rohm and Haas Company, and Hycar 2600 X 322, Hycar 2671, Hycar 2679, Hycar 26120, and Hycar 2600 X347 from B.F. Goodrich Chemical Group, polystyrene latex containing 50 percent of water and 50 percent of polystyrene, such as DL6622A, DL6688A, and DL6687A from Dow Chemical Company, styrene-butadiene latexes, such as 76 RES 4100 and 76 RES 8100 available from Union Oil Chemicals Division, Tylac resin emulsion 68-412, Tylac resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A from Dow Chemical Company, butadiene-acrylonitrile latex, such as Hycar 1561 and Hycar 1562 from B.F. Goodrich Chemical Group, and Tylac Synthetic Rubber Latex 68-302 from Reichhold Chemicals Inc., butadiene-acrylonitrile-styrene terpolymer latex, such as Tylac synthetic rubber latex 68-513 from Reichhold Chemicals Inc., mixtures thereof, and the like; and (B) water soluble anionic polymers, such as (1) carboxy alkyl cellulose salts, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethyl cellulose CMC 7HOF, available from Hercules Chemical Company; (2) cellulose sulfate salts, wherein the cation is any conventional cation, such as sodium, lithium, potassium, calcium, magnesium, or the like, such as sodium cellulose sulfate #023 available from Scientific Polymer Products; and (3) carboxyalkylhydroxyalkyl cellulose salts, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethylhydroxyethyl cellulose CMHEC 43H and 37L available from Hercules Chemical Company; and mixtures thereof.

Examples of the second cationic layer which itself is situated on the top of the first anionic layer in contact with the substrate include water soluble polymers, such as (1) dialkyl ammonium hydrolyzed collagen protein, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as dimethyl ammonium hydrolyzed collagen protein, available from Croda as Croquats; (2) amino deoxycellulose, which can be prepared by the reaction of chlorodeoxy cellulose with 19 percent alcoholic solution of ammonia for 6 hours at 160° C.; (3) dialkylammonium halide hydroxy alkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as diethylammonium chloride hydroxy ethyl cellulose, available as Celquat H-100, L-200, National Starch and Chemical Company; (4) hydroxyalkyl trialkyl ammonium halide hydroxyalkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as hydroxypropyl trimethyl ammonium chloride hydroxyethyl cellulose, available from Union Carbide Company as Polymer Jr; (5) dialkyl amino alkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl amino ethyl cellulose, available from Poly Sciences Inc. as diethylaminoethyl cellulose #05178; (6) quaternary acrylic copolymer; (7) formaldehyde-free GARDOL DR/NF™, available from Apollo Chemical Corporation; (8) polyquaternary amine PERCHEM 553™, available from Chem Link Industrial; (9) polyquaternary amine POLY PLUS 1290™, available from Betz Paper Chem Inc; (10) ARMOSOFT 420-90™, available from Akzo Chemie Chemicals; (11) Mirapol A-15 and Mirapol WT, available from Miranol, Incorporated, Dayton, N.J., prepared as disclosed in U.S. Pat. No. 4,157,388, the disclosure of which is totally incorporated herein by reference, Mirapol AZ-1, available from Miranol, Inc., prepared as disclosed in U.S. Pat. No. 4,719,282, the disclosure of which is totally incorporated herein by reference, Mirapol AD-1, available from Miranol, Inc., prepared as disclosed in U.S. Pat. No. 4,157,388, Mirapol 9, Mirapol 95, and Mirapol 175, available from Miranol, Inc., Dayton, N.J., prepared as disclosed in U.S. Pat. No. 4,719,282, and the like. Other suitable cationic dye mordants comprise diamino alkanes, quaternary salts, and quaternary acrylic copolymer latexes.

Also suitable are monoammonium compounds as disclosed in, for example, U.S. Pat. No. 5,320,902, the disclosure of which is totally incorporated herein by reference, including (A) tetra alkyl ammonium salts, including tetramethyl ammonium bromide (Aldrich 19,575-8), tetramethyl ammonium chloride (Aldrich T1,952-6), tetramethyl ammonium iodide (Aldrich 23,594-6), tetraethyl ammonium bromide (Aldrich 24.105-9), tetraethyl ammonium chloride (Aldrich 11304-2), tetraethyl ammonium iodide (Aldrich 23,593-8), tetrapropyl ammonium bromide (Aldrich 22,556-8), tetrapropyl ammonium iodide (Aldrich 23,595-4), tetrabutyl ammonium bromide (Aldrich 19,311-9), tetrabutyl ammonium chloride (Aldrich 28,888-8), tetrabutyl ammonium iodide (Aldrich 14,077-5), tetrapentyl ammonium bromide (Aldrich 24,197-0), tetrapentyl ammonium chloride (Aldrich 25,896-2), tetrahexyl ammonium chloride (Aldrich 26,383-4), tetrahexyl ammonium bromide (Aldrich 25,281-6), tetrahexyl ammonium iodide (Fluka 87307), tetrahexyl ammonium hydrogen sulfate (Fluka 87299), tetraheptyl ammonium bromide (Aldrich 23,784-1), tetraoctyl ammonium bromide (Aldrich 29,413-6), tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) monosubstituted trialkyl ammonium salts, such as 2-aminoethyl trimethyl ammonium chloride hydrochloride (Aldrich 28,455-6), 2-bromoethyl trimethyl ammonium bromide (Aldrich 11,719-6), 2-chloroethyl trimethyl ammonium chloride (Aldrich 23,443-5), hexamethylene bistrimethyl ammonium bromide (Aldrich 21,967-3, Fluka 52590), hexamethylene bistrimethyl ammonium chloride (Fluka 52600), and 3-carboxypropyl ammonium chloride (Aldrich 23,443-5), decamethylene bis trimethyl ammonium bromide of the formula $[—(CH_2)_5—N(CH_3)_3Br]_2$ (Aldrich 28,547-1), phenyl trimethyl ammonium bromide (Aldrich 13,532-1), phenyl trimethyl ammonium chloride (Aldrich 19,916-8), phenyl trimethyl ammonium iodide (Aldrich 13,914-9), phenyl trimethyl ammonium methosulfate (Aldrich 25,943-6), benzyl trimethyl ammonium chloride (Aldrich 22,557-6, Hipochem Migrator J from High Point Chemical Corporation, Variquat B200 from Sherex Chemicals), benzyl trimethyl ammonium bromide (Aldrich 14,711-7), benzyl triethyl ammonium chloride (Aldrich 14,655-2), benzyl triethyl ammonium bromide (Aldrich 14,712), benzyl tributyl ammonium chloride (Aldrich 19,377-1), benzyl tributyl ammonium bromide (Aldrich 24,378-7), benzyl tributyl ammonium iodide (Aldrich 29,301-6), 4-nitrobenzyl trimethyl ammonium chloride (Aldrich 29,369-5) coco trimethyl ammonium chloride (Arquad C-33, C-33W, C-50 from Akzo Chemie, Noramium MC-50 from Diamond Shamrock, Jet Quat C-50 from Jetco Chemicals, Quartamin CPR from Kao Corporation), palmityl trimethyl ammonium chloride (Adogen 444 from Sherex Chemicals), myristyl trimethyl ammonium bromide (Aldrich 86,042-5), Cetrimide BP Triple Crown America), oleyl trimethyl ammonium chloride (Noramium MO-50 from Diamond Shamrock), soya trimethyl ammonium chloride (Arquad S-20 Akzo Chemie, Jet Quat S-2C-50 Jetco Chemicals, Tomah Q-S from Tomah), tallow trimethyl ammonium chloride (Arquad T-50, T-27W Akzo Chemie, Jet Quat T-50 Jetco Chemicals, Quartamin TPR from Kao Corporation, Radiaquat 6471 from Oleofina S. A., Adogen 471 from Sherex Chemicals, Querton BGCL50 from Kenobel), hydrogenated tallow trimethyl ammonium chloride (Noramium MSH-50 from Diamond Shamrock, Quartamin HTPR from Kao Corporation, Adogen 441 from Sherex Chemicals), ricinoleamidopropyl trimethyl ammonium methyl sulfate (Rewoquat RTM50, Rewo Quimica), stearyl trimethyl ammonium chloride (Arquad 18-50 from Akzo Chemie), behenyl trimethyl ammonium chloride (Incroquat TMC/P; Croda Universal Inc.), behenyl trimethyl ammonium methosulfate (Incroquat TMS; Croda Universal Inc.), guar hydroxypropyl trimethyl ammonium chloride (cationic guar C-261 from Henkel), butyl tripropyl ammonium bromide (Aldrich 28038-0), methyl tributyl ammonium chloride (Aldrich 25,516-5), methyl tributyl ammonium bromide (Fluka 90802), methyl tributyl ammonium iodide (Fluka 90804), heptyl tributyl ammonium bromide (Fluka 90797), and the like; (C) disubstituted dialkyl ammonium salts including N,N-dimethyl methylene ammonium chloride (Aldrich 32,449-3), N,N-dimethyl methylene ammonium iodide (Aldrich 21,491-4), chloromethylene dimethyl ammonium chloride (Aldrich 28,090-9), dichloromethylene dimethyl ammonium chloride (Aldrich 16,287-6), 1,5-dimethyl-1,5-diaza undecamethylene polymethobromide (hexadimethrine bromide, Aldrich 10,768-9), dodecyl benzyl dimethyl ammonium bromide (Aldrich 28,088-7), dodecyl benzyldimethyl ammonium chloride (Loraquat B50 Dutton and Reinisch Ltd., Retarder N from Hart Chemicals), coco benzyl dimethylammonium chloride (Merpiquat K-8-2 from Kempen; Nissan cation F2-10R, F2-20R, F2-40E, F2-50 from Nippon Oils and Fats; Querton KKBCL from Lilachim), benzyl tetradecyl dimethyl ammonium chloride (Arquad DM 14B-90 from Akzo Chemie, Variquat 50ME, 80ME from Sherex Chemicals, Cyncal from Hilton-Davis Chemicals, Aldrich 29,279-6), benzyl cetyl dimethyl ammonium chloride (Querton 16BCL from Lilachim, Aldrich 22,900-8), benzyl octadecyl dimethyl ammonium chloride (Arquad DM 18B-90 Akzo Chemie, Varisoft 6112 from Sherex Chemicals, Nissan Cation S2-100 from Nippon Oils and Fats, Carsosoft SDQ-25, SDQ-85 from Lonza Inc., Aldrich 22,901-6), benzyl tallow dimethyl ammonium chloride (Kemamine BQ-9742C from Witco Chemicals and Noramium S-75 from Diamond Shamrock), benzyl hydrogenated tallow dimethyl ammonium chloride (Arquad DMHTB-75 from Akzo Chemie, Kemamine BQ-9702C from Witco Chemicals, Querton 441-BC, HBG BCL from Kenobel), benzyl behenyl dimethyl ammonium chloride (Incroquat behenyl BDQ/P from Croda Universal Inc.; Kemamine Q-2802-C from Witco Chemicals), dioctyl dimethyl ammonium chloride (Querton 28CL from Lilachim), didecyl dimethyl ammonium chloride (Bio-Dac from Bio-Lab Inc., Querton 210 CL from Lilachim, Bardac 2250 from Lonza Inc., BTC 1010 from Onyx Chemicals), didecyl dimethyl ammonium bromide (Aldrich 29,801-8), dicoco dimethyl ammonium chloride (Accoquat 2C-75 from Armstrong Chemical Company Ltd., Kemamine Q-6503C from Witco, Jet Quat 2C-75 from Jetco Chemicals, M-Quat 2475 from Mazer, Quartamine DCP from Kao Corporation, Arquad 2C-75 from Akzo Chemie, Radiaquat 6462 from Oleofina S. A., Variquat K300 from Sherex Chemicals, Adogen 462 from Sherex Chemicals), dicetyl dimethyl ammonium chloride (Adogen 432CG from Sherex Chemicals), distearyl dimethyl ammonium methyl sulfate (Varisoft 137, 190-100P from Sherex Chemicals, Arosurf TA-100 from Sherex Chemicals), disoya dimethyl ammonium chloride (Arquad 2S-75 from Akzo Chemie), ditallow dimethyl ammonium chloride (Adogen 470 from Sherex Chemicals), dihydrogenated tallow dimethyl ammonium methyl sulfate (Accosoft 748 from Stepan), dihydrogenated tallow dimethyl ammonium chloride (Arquad 2HT-75 from Akzo Chemie, Kemamine Q-9702C from Witco, Carsosoft V-90, V-100 from Lonza Inc., Adogen 442 from Sherex Chemicals, Varisoft 3262, Varisoft DHT from Sherex Chemicals, Radiaquat 6442 from Oleofina S. A., Jet Quat 2HT-75 from Jetco Chemicals, Accosoft 707 from Stepan), dibehenyl/diarachidyl dimethyl ammonium chloride (Kemamine Q-1902C, 1302C from Witco Chemicals), 1:1 blend of oleyl trimethyl ammonium chloride and dicoco dimethyl ammonium chloride (Arquad S-2C-50 from Akzo Chemie), 1:1 blend of trimethyl tallow ammonium chloride and dimethyl dicoco ammonium chloride (Arquad T-2C-50 from Akzo Chemie and Adogen R-6 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), N-cetyl, and N-ethyl morpholinium ethosulfate (G-263 from ICI Americas).

Also suitable are phosphonium compounds, such as, for example, those disclosed in copending application U.S. Ser. No. 08/034,917, the disclosure of which is totally incorporated herein by reference, including monophosphonium compounds containing one cationic phosphonium moiety, diphosphonium compounds containing two cationic phosphonium moieties, and polyphosphonium compounds containing more than two cationic phosphonium moieties. Examples of suitable phosphonium compounds include methyl triphenyl phosphonium bromide (Aldrich 13,007-9), methyl triphenyl phosphonium iodide (Aldrich 24,505-4), ethyl triphenyl phosphonium bromide (Aldrich E5,060-4), n-propyl triphenyl phosphonium bromide (Aldrich 13,156-3), isopropyl triphenyl phosphonium iodide (Aldrich 37,748-1), cyclopropyl triphenyl phosphonium bromide (Aldrich 15,731-7), n-butyl triphenyl phosphonium bromide (Aldrich B10,280-6), isobutyl triphenyl phosphonium bromide (Aldrich 37,750-3), hexyl triphenyl phosphonium bromide (Aldrich 30,144-2), benzyl triphenyl phosphonium chloride (Aldrich B3,280-7), bromomethyl triphenyl phosphonium bromide (Aldrich 26,915-8), chloromethyl triphenyl phosphonium chloride (Aldrich C5,762-6), 3-bromopropyl triphenyl phosphonium bromide (Aldrich 13,525-9), 3-bromobutyl triphenyl phosphonium bromide (Aldrich 30,537-5), 4-bromobutyl triphenyl phosphonium bromide (Aldrich 27,213-2), 2-dimethyl aminoethyl triphenyl phosphonium bromide (Aldrich 21,544-9), [(3-dimethyl amino) propyl] triphenyl phosphonium bromide (Aldrich 30,585-5), 2-hydroxyethyl triphenyl phosphonium bromide (Aldrich 30,413-1), (2-hydroxyethyl) triphenyl phosphonium chloride (Aldrich H3,065-8), [3-hydroxy-2-methyl propyl] triphenyl phosphonium bromide (Aldrich 32,507-4, Aldrich 32,508-2), 2-hydroxybenzyl triphenyl phosphonium bromide (Aldrich 21,629-1), (formyl methyl) triphenyl phosphonium chloride (Aldrich 30,532-4), (methoxymethyl) triphenyl phosphonium chloride (Aldrich 30,956-7), acetonyl triphenyl phosphonium chloride (Aldrich 15,807-0), carbomethoxymethyl triphenyl phosphonium bromide (Aldrich 25,906-3), (ethoxy carbonyl methyl) triphenyl phosphonium chloride (Aldrich 30,531-6), carbethoxymethyl triphenyl phosphonium bromide (Aldrich C530-0), (tert-butoxy carbonyl methyl) triphenyl phosphonium bromide (Aldrich 36,904-7), phenacyl triphenyl phosphonium bromide (Aldrich 15,133-5), (4-ethoxybenzyl) triphenyl phosphonium bromide (Aldrich 26,648-5), 4-butoxybenzyl triphenyl phosphonium bromide (Aldrich 27,489-5), 2-(1,3-dioxan-2-yl) p-xylylene bis(triphenyl phosphonium bromide) (Aldrich 112-1), tetraphenyl phosphonium bromide (Aldrich 21,878-2), tetraphenyl phosphonium chloride (Aldrich 21,879-0), tetraphenyl phosphonium Iodide (Aldrich 21,880-4), hexadecyl tributyl phosphonium bromide (Aldrich 27,620-0), stearyl tributyl phosphonium bromide (Aldrich 29,303-2), tetramethyl phosphonium bromide (Aldrich 28,826-8), tetramethyl phosphonium chloride (Aldrich 28,827-6), tetraethyl phosphonium bromide (Aldrich 33,365-4), tetraethyl phosphonium chloride (Aldrich 32,539-2), tetraethyl phosphonium iodide (Aldrich 32,540-6), tetrabutyl phosphonium bromide (Aldrich 18,913-8), tetrabutyl phosphonium chloride (Aldrich 14,480-0), and the like, as well as mixtures thereof; ammonium quaternary salts as disclosed in U.S. Pat. No. 5,320,902; phosphonium quaternary salts as disclosed in copending application U.S. Ser. No. 08/034,917; and sulfonium, thiazolium and benzothiazolium quaternary salts as disclosed in U.S. Pat. No. 5,314,747, the disclosures of each of which are totally incorporated herein by reference.

In addition, the second cationic layer may contain lightfastness inducing agents, which are comprised of a mixture of an antioxidant and UV absorbing compounds, which compounds include glycerol ρ-amino benzoate, available as Escalol 106 from Van Dyk Corporation; resorcinol mono benzoate, available as RBM from Eastman Chemicals; octyl dimethyl amino benzoate, available as Escalol 507 from Van Dyk Corporation; hexadecyl 3,5-di-tert-butyl-4-hydroxybenzoate, available as Cyasorb UV-2908, #41,320-8, from Aldrich Chemical Company; octyl salicylate, available as Escalol 106 from Van Dyk Corporation; octyl methoxy cinnamate, available as Parasol MCX from Givaudan Corporation; 4-allyloxy-2-hydroxybenzophenone, available as Uvinul 600, #41,583-9, from Aldrich Chemical Company; 2-hydroxy-4-methoxy benzophenone, available as Anti UVA from Acto Corporation; 2,2'-dihydroxy-4,4'-dimethoxy benzophenone, available as Uvinul D 49, #D11,100-7, from Aldrich Chemical Company; 2-hydroxy-4-(octyloxy) benzophenone, available as Cyasorb UV-531, #41,315-1, from Aldrich Chemical Company; 2-hydroxy-4-dodecyloxy benzophenone, available as DOBP from Eastman Chemicals; 2-(2'-hydroxy-5'-methylphenyl)benzotriazole, available as Tinuvin 900 from Ciba Geigy Corporation; 2-[2'-hydroxy-3,5-di-(1,1-dimethyl benzyl)phenyl]-2H-benzotriazole, available as Topanex 100BT from ICI America Corporation; bis[2-hydroxy-5-tert-octyl-3-(benzotriazol-2yl) phenyl methane, available as Mixxim BB/100 from Fairmount Corporation; 2-(3', 5'-di-tert-butyl-2'-hydroxyphenyl)-5-chlorobenzotriazole, available as Tinuvin 327 from Ciba Geigy Corporation; 2-(4-benzoyl-3-hydroxyphenoxy)ethylacrylate (Cyasorb UV-416, #41,321-6, available from Aldrich Chemical Company), poly[2-(4-benzoyl-3hydroxyphenoxy)ethylacrylate] (Cyasorb UV-2126, #41,323-2, available from Aldrich Chemical Company), N-(ρ-ethoxycarbonyl phenyl)-N'-ethyl-N'-phenyl formadine, available as Givesorb UV-2 from Givaudan Corporation; 1,1-(1,2-ethane-diyl) bis(3,3,5,5-tetramethyl piperazinone), available as Good-rite UV 3034 from Goodrich Chemicals; tris(3,5-di-tert-butyl-4hydroxybenzyl)isocyanurate, available as Good-rite UV 3114 from Goodrich Chemicals; nickel bis(o-ethyl(3,5-di-tert-butyl-4-hydroxybenzyl) phosphonate, available as Irgastab 2002 from Ciba Geigy Corporation; [2,2,6,6-tetramethyl-4-piperidinyl)-1,2,3,4-butane tetracarboxylate, available as Mixxim HALS 5 from Fairmount Corporation; [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68 from Fairmount Corporation; [1,2,2,6,6-pentamethyl-4-piperidinyl/β, β,β',β'-tetramethyl-3,9-(2,4,8,10-tetraoxospiro (5,5) undecane)diethyl]-1,2,3,4-butane tetracarboxylate, available as Mixxim HALS 63 from Fairmount Corporation; 2-dodecyl-N-(2,2,6,6-tetramethyl-4-piperidinyl) succinimide, available as Cyasorb UV-3581, #41,317-8, from Aldrich Chemical Company); 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)-2-dodecyl succinimide, available as Cyasorb UV-3668, #41,319-4, from Aldrich Chemical Company; tetra sodium N-(1,2-dicarboxyethyl)-N-octadecyl sulfosuccinamate, available as Aerosol 22N from American Cyanamid Corporation; nickel dibutyldithiocarbamate, available as UV-Chek AM-105 from Ferro Corporation; poly(4-hydroxy-2,2,6,6-tetramethyl-1-piperidine ethanol/ dimethyl succinic acid), available as Tinuvin 622LD from Ciba-Geigy Corporation; poly(3,5-di-tert-butyl-4-hydroxy hydrocinnamic acid ester/1,3,5-tris(2-hydroxyethyl)-5-triazine-2,4,6(1H,3H,5H)-trione, available as Good-rite 3125 from Goodrich Chemicals; poly[N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0, from Aldrich Chemical Company; 1-[N-[poly(3-allyloxy-2-hydroxypropyl)-2-aminoethyl]-2-imidazolidinone, #41,026-8 available from Aldrich Chemical Company; and poly(2-ethyl-2-oxazoline), #37,284-6, #37,285-4, #37,397-4, available from Aldrich Chemical Company.

Examples of antioxidant compounds include didodecyl 3,3'-thiodipropionate, available as Cyanox, LTDP, #D12, 840-6, from Aldrich Chemical Company; ditridecyl 3,3'-thiodipropionate, available as Cyanox 711, #41,311-9, from Aldrich Chemical Company; ditetradecyl 3,3'thiodipropionate, available as Cyanox, MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox, STDP, #41,310-0, from Aldrich Chemical Company; triethyleneglycol bis[3-(3'-tert-butyl-4'-hydroxy-5'-methylphenyl) propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis [methylene(3,5-di-tert-butyl-4-hydroxy hydrocinnamate), available as Irganox 1010 from Ciba-Geigy Corporation; thiodiethylenebis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N '-hexamethylenebis(3,5-di-tert-butyl-4-hydroxy hydrocinnamide), available as Irganox 1098 from Ciba-Geigy Corporation; 2,2-bis[4-(2-(3,5-di-tert-butyl-4-hydroxyhydrocinnamoyloxy))ethoxy phenyl] propane, available as Topanol 205 from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox KB from Mobay Chemicals; 2,6-di-tert-butyl-α-dimethylamino-ρ-cresol, available as Ethanox 703 from Ethyl Corporation; 2,2'-isobutylidene-bis(4,6-dimethyl phenol), available as Vulkanox NK from Mobay Chemicals; 2,2'-methylenebis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LE65 from Harcros Corporation; tris(nonyl phenyl) phosphite, available as Lankromark LE 109 from Harcros Corporation; tris(2,4-di-tert-butyl-phenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-β-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622 from Vanderbilt Corporation; molybdenum oxysulfide dithio carbamate, available as Vanlube 62 from Vanderbilt Corporation; 2,2,4-trimethyl-1,2-hydroquinoline, available as Vulkanox HS from Mobay Corporation; and mixtures thereof.

Examples of antiozonants that may be present in the lightfastness agent mixture include N-isopropyl-N'-phenyl-phenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis (1,4-dimethyl pentyl)-ρ-phenylene diamine, available as Santoflex 77 from Monsanto Chemicals; 2,4,6-tris-(N-1,4-dimethyl pentyl-ρ-phenylene diamino)-1,3,5-triazine, available as Durazone 37 from Uniroyal Corporation; 6-ethoxy-1,2-dihydro-2,2,4-trimethyl quinoline, available as Santoflex AW from Monsanto Chemicals; bis-(1,2,3,6-tetrahydrobenzaldehyde) pentaerythritol acetal, available as Vulkazon AFS/LG from Mobay Corporation; Paraffin Wax, available as Petrolite C-700, Petrolite C-1035, from Petrolite Corporation; and mixtures thereof. In embodiments, the lightfastness mixture contains effective amounts of each component as illustrated herein and, for example, 3 weight percent of antioxidant, 3 weight percent of UV component, and 1 percent of antiozoant.

Examples of the third layer ink receiving polymers that are more compatible with the fast drying colored inks in contact with the second cationic layer, which itself is situated on the top of the first anionic layer in contact with the substrate, include water soluble polymers such as:

(A) vinyl polymers, such as (1) poly(vinyl alcohol), 88 percent hydrolyzed, available as Airvol 205, Airvol 523, Airvol 540S from Air Products Company, #333, #334 available from Scientific Polymer Products, 98 percent hydrolyzed, such as #363, #362 available from Scientific Polymer Products; (2) poly(vinyl phosphate), such as #4391 available from Poly Sciences Inc.; (3) poly(vinyl pyrrolidone), such as that available from GAF Corporation; (4) vinyl pyrrolidone-vinyl acetate copolymers, such as #02587 available from Poly Sciences Inc.; (5) vinyl pyrrolidone-styrene copolymers, such as #371 available from Scientific Polymer Products; (6) poly(vinylamine), such as #1562 available from Poly Sciences Inc., (7) poly(vinyl alcohol) alkoxylated, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl alcohol) ethoxylated #6573, available from Poly Sciences Inc.; and (8) poly(vinyl pyrrolidone-dialkylaminoalkyl alkylacrylate), wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl pyrrolidone-diethylamino-methylmethacrylate), #16294 and #16295, available from Poly Sciences Inc.; and (B) the nonionic polysaccharides that are more compatible with the fast drying colored inks and are involved in the synthesis of scrambled block copolymers of the third ink receiving layer include (1) starch, such as starch SLS-280 available from St. Lawrence starch; (2) hydroxyalkyl starch, wherein alkyl has at least one carbon atom, and wherein the number of carbon atoms is such that the material is water soluble, preferably from about 1 to about 20 carbon atoms, and more preferably from about 1 to about 10 carbon atoms, such as methyl, ethyl, propyl, butyl, or the like, such as hydroxypropyl starch (#02382, available from Poly Sciences Inc.), and hydroxyethyl starch (#06733, available from Poly Sciences Inc.); (3) gelatin, such as Calfskin Gelatin #00639 available from Poly Sciences Inc.; (4) alkyl celluloses and aryl celluloses, wherein alkyl has at least one carbon atom, and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like, such as methyl cellulose (Methocel AM 4, available from Dow Chemical Company), #27,444-5, #18,804-2, #27,442-9, #27,443-7, #27,441-0, all being available from Aldrich Chemicals, and wherein aryl has at least 6 carbon atoms, and wherein the number of carbon atoms is such that the material is water soluble, preferably from 6 to about 20 carbon atoms, more preferably from 6 to about 10 carbon atoms, and even more preferably about 6 carbon atoms, such as phenyl; (5) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as hydroxyethyl cellulose, Natrosol 250 LR available from Hercules Chemical Company, and hydroxypropyl cellulose (Klucel Types A, B, C, D and E available from Hercules Chemical Company), #401, #402, #403, #404, all being available from Scientific Polymer Products Incorporated; (6) alkyl hydroxy alkyl celluloses, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose, Bermocoll available from Berol Kem. A. B. Sweden; (7) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM available from British Celanese Ltd., also available as Tylose MH, MHK from Kalle A. G.), hydroxypropyl methyl cellulose (Methocel 1(35LV, available from Dow Chemical Company), #423 available from Scientific Polymer Products Incorporated, and hydroxy butylmethyl cellulose, such as HBMC available from Dow Chemical Company; (8) dihydroxyalkyl cellulose, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as dihydroxypropyl cellulose, which can be prepared by the reaction of 3-chloro-1,2-propane with alkali cellulose; (9) hydroxy alkyl hydroxy alkyl cellulose, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxypropyl hydroxyethyl cellulose, available from Aqualon Company; (10) halodeoxycellulose, wherein halo represents a halogen atom, such as chlorodeoxycellulose, which can be prepared by the reaction of cellulose with sulfuryl chloride in pyrridine at 25° C.; (11) gum arabic, such as #G9752 available from Sigma Chemical Company; (12) carrageenan, such as #C1013 available from Sigma Chemical Company; (13) karaya gum, such as #G0503 available from Sigma Chemical Company; (14) xanthan, such as Keltrol-T available from Kelco division of Merck and Company; (15) chitosan, such as #C3646 available from Sigma Chemical Company; and (16) agar-agar, such as that available from Pfaltz and Bauer Inc.

Examples of the third ink receiving layer polymers that are more compatible with the slow drying black inks, in contact with the second cationic layer which itself is situated on the top of the first anionic layer in contact with the substrate, include water soluble polymers such as:

(A) alkylene oxide polymers, such as (1) poly (oxyethylene) or poly(ethylene oxide), such as POLY OX WSRN-3000 available from Union Carbide Corporation, #345, #344, #343, #136E, #136D, #136B, #136A, all being available from Scientific Polymer Products Incorporated; (2) ethylene oxide/2-hydroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobisisobutyronitrile as initiator, and reacting the resulting amino-semitelechelic oligo-hydroxyethyl methacrylate or amino-hydroxypropyl methacrylate with an isocyanate-polyethylene oxide complex in chlorobenzene at 0° C., and precipitating the reaction mixture in diethylether, filtering and drying in vacuum; (3) ethylene oxide/4-vinyl pyridine/ethylene oxide triblock copolymers, which can be synthesized via anionic polymerization, of 4-vinyl pyridine with sodium naphthalene as initiator at −78° C., and then adding ethylene oxide monomer, the reaction being carried out in an explosion proof stainless steel reactor, ionene/ethylene oxide/ionene triblock copolymers, which can be synthesized via quaternization reaction of one end of each 3-3 ionene with the halogenated, preferably brominated, poly(oxyethylene) in methanol at about 40° C.; (4) ethylene oxide/isoprene/ethylene oxide triblock copolymers, which can be synthesized via anionic polymerization of isoprene with sodium naphthalene in tetrahydrofuran as solvent at −78° C., and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, as well as mixtures thereof;

(B) acrylic polymers (1) acrylic copolymer DP6-6066, acrylic copolymer DP6-7132 obtained from Allied Colloids; (2) poly(acrylamide), such as #02806 available from Poly Sciences Inc., #001 available from Scientific Polymer Products Incorporated; (3) acrylamide-acrylic acid copolymers, such as #04652, #02220, and #18545 available from Poly Sciences Inc.; (4) poly(N,N-dimethyl acrylamide), such as #004590 available from Poly Sciences Inc.; and (5) polyacrylic acid such as #026, #413 , #597, #598, #599, #600, available from Scientific Polymer Products Incorporated;

(C) formaldehyde resins, such as (1) melamine-formaldehyde resin (such as BC 309, available from British Industrial Plastics Limited); (2) urea-formaldehyde resin (such as BC777, available from British Industrial Plastics Limited); and (3) alkylated urea-formaldehyde resins, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated ureaformaldehyde resins available from American Cyanamid Company as Beetle 65);

(D) maleic anhydride and maleic acid containing polymers, such as (1) styrene-maleic anhydride copolymers (such as that available as Scripset from Monsanto, and the SMA series available from Arco); (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173 available from Scientific Polymer Products); (3) alkylene-maleic anhydride copolymers, wherein alkylene has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308 available from Poly Sciences Inc., also available as EMA from Monsanto Chemical Company); (4) butadiene-maleic acid copolymers (such as #07787 available from Poly Sciences Inc.); (5) vinylalkylether-maleic acid copolymers, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer available from GAF Corporation as Gantrez S-95); and (6) alkyl vinyl ether-maleic acid esters, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773 available from Scientific Polymer Products); and (E) imine polymers such as (1) poly(ethylene imine) (such as #135 available from Scientific Polymer Products); (2) poly(ethylene imine) epichlorohydrin (such as #634 available from Scientific Polymer Products); and (3) alkoxylated poly(ethylene imine), wherein alkyl has one (methoxylated), two (ethoxylated), three (propoxylated), or four (butoxylated) carbon atoms (such as ethoxylated poly(ethylene imine) #636 available from Scientific Polymer Products.

Examples of suitable biocides selected for the third ink receiving layer include (A) nonionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB available from Buckman Laboratories Inc.); (3) methylene bis (thiocyanate) (Metasol T-10 available from Calgon Corporation; AMA-110 available from Vinings Chemical Company; VICHEM MBT available from Vineland Chemical Company; Aldrich 10,509-0); (4) 2-bromo-4'-hydroxyacetophenone (Busan 90 available from Buckman Laboratories); (5) 1,2-dibromo-2,4-dicyano-butane (Metasol CB-210, CB-235 available from Calgon Corporation); (6) 2,2-dibromo-3-nitropropionamide (Metasol RB-20 available from Calgon Corporation; Amerstat 300 available from Drew Industrial Div.); (7) N-α-(1-nitroethyl benzylethylene diamine) (Metasol J-26 available from Calgon Corporation); (8) dichlorophene (G-4 available from Givaudan Corporation); (9) 3,5-dimethyl tetrahydro-2H-1,3,5-thiadiazine-2-thione (Slime-Trol RX-28 available from Betz Paper Chem Inc.; Metasol D3T-A available from Calgon Corporation; Slime Arrest available from Western Chemical Company); (10) a nonionic blend of a sulfone, such as bis(trichloromethyl) sulfone and methylene bisthiocyanate (available as Slime-Trol RX-38A from Betz Paper Chem Inc.); (11) a nonionic blend of methylene bisthiocyanate and bromonitrostyrene (available as Slime-Trol RX-41 from Betz Paper Chem Inc.); (12) a nonionic blend of 2-(thiocyanomethylthio) benzothiazole (53.2 percent by weight) and 2-hydroxypropyl methanethiosulfonate (46.8 percent by weight) (available as Busan 25 from Buckman Laboratories Inc.); (13) a nonionic blend of methylene bis(thiocyanate), 50 percent by weight, and 2-(thiocyanomethylthio) benzothiazole, 50 percent by weight, (available as Busan 1009, 1009WB from Buckman Laboratories Inc.); (14) a nonionic blend of 2-bromo-4'-hydroxyacetophenone, 70 percent by weight, and 2-(thiocyanomethylthio) benzothiazole, 30 percent by weight, (Busan 93 available from Buckman Laboratories Inc.); (15) a nonionic blend of 5-chloro-2-methyl-4-isothiazoline-3-one, 75 percent by weight, and 2-methyl-4-isothiazolin-3-one, 25 percent by weight, available as Amerstat 250 from Drew Industrial Division; Nalcon 7647 from Nalco Chemical Company; Kathon LX from Rohm and Haas Company; and the like, as well as mixtures thereof; (B) anionic biocides, such as (1) anionic potassium N-hydroxymethyl-N-methyl-dithiocarbamate (available as Busan 40 from Buckman Larboratories Inc.); (2) an anionic blend of N-hydroxymethyl-N-methyl dithiocarbamate, 80 percent by weight, and sodium 2-mercapto benzothiazole, 20 percent by weight, (available as Busan 52 from Buckman Laboratories Inc.); (3) an anionic blend of sodium dimethyl dithiocarbamate, 50 percent by weight, and disodium ethylene bisdithiocarbamate, 50 percent by weight, (available as Metasol 300 from Calgon Corporation; Amerstat 272 from Drew Industrial Division; Slime Control F from Western Chemical Company); (4) an anionic blend of N-methyldithiocarbamate, 60 percent by weight, and disodium cyanodithioimidocarbonate, 40 percent by weight, (available as Busan 881 from Buckman Laboratories Inc.);

(5) an anionic blend of methylene bisthiocyanate, 33 percent by weight, sodium dimethyl-dithiocarbamate, 33 percent by weight, and sodium ethylene bisdithiocarbamate, 33 percent by weight, (available as Amerstat 282 from Drew Industrial Division; AMA-131 from Vinings Chemical Company); (6) sodium dichlorophene (G-4-40, available from Givaudan Corporation); and the like, as well as mixtures thereof; (C) cationic biocides, such as (1) cationic poly(oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as Slime-Trol RX-31, RX-32, RX-32P, RX-33 from Betz Paper Chem Inc.); (3) a cationic blend of a sulfone, such as bis (trichloromethyl) sulfone and a quaternary ammonium chloride (available as Slime-Trol RX-36 DPB-865 from Betz Paper Chem. Inc.); (4) a cationic blend of methylene bisthiocyanate and chlorinated phenols (available as Slime-Trol RX-40 from Betz Paper Chem Inc.); and the like, as well as mixtures thereof. The biocide can be present in any effective amount; typically, the biocide is present in an amount of from about 0.1 percent by weight to about 3 percent by weight of the coating, although the amount can be outside this range.

Examples of the third ink receiving layer filler components include hollow microspheres, include Eccospheres MC-37 (sodium borosilicate glass), Eccospheres FTD 202 (high silica glass, 95 percent $S102_2$), and Eccospheres SI (high silica glass, 98 percent $S10_2$), all available from Emerson and Cuming Inc.; Fillite 200/7 (alumino-silicate ceramic available from Fillite U.S.A.); Q-Cel 300 (sodium borosilicate available from Philadelphia Quartz); B23/500 (soda lime glass available from 3M Company); Ucar B J0-0930 (phenolic polymers available from Union Carbide); Miralite 177 (vinylidene chloride-acrylonitrile available from Pierce & Stevens Chemical Corporation); and the like. Examples of solid microspheres include Spheriglass E250P2 and 10002A (soda-lime glass A-glass, E-glass), available from Potters Industries; Micro-P (soda-lime glass) available from D.J. Enterprises; ceramic microspheres (available from Fillite U.S.A. and Zeelan Industries); glass beads, 3 to 10 microns, (#07666 available from Polymer Sciences Inc.); solid plastic microspheres available from Rohm & Haas, Dow Chemicals, Diamond Shamrock, and E.I. DuPont de Nemours & Company; hollow composite microspheres of polyvinylidene chloride/acrylonitrile copolymer shell, 15 percent by weight, and calcium carbonate, 85 percent by weight, available as Dualite M 6001 AE, and Dualite M 6017 AE from Pierce & Stevens Corporation; and the like. Mixtures of two or more types of microspheres can also be employed. Further information regarding microspheres is disclosed in, for example, *Encyclopedia of Polymer Science and Engineering*, vol. 9, pages 788 et seq., John Wiley and Sons (New York 1987), the disclosure of which is totally incorporated herein by reference, stearate coated calcium carbonate, available as Camet-CAL, Camet-CAL ST from Genstar Stone Products Company; sodium metasilicate anhydrous available as Drymet 59 from Crossfield Chemicals, Incorporated, sodium metasilicate pentahydrate Crystamet 1020, Crystamet 2040, Crystamet 3080 from Crossfield Chemicals, Incorporated; organophilic montmorillonitrile clay available as Bentone 38CG, and magnesium aluminum silicate chemically modified available as Bentone 38EV from Rheox Incorporated; magnesium carbonate available as Elastocarb Tech Light, Elastocarb Tech Heavy, Elastocarb UF from Morton International; magnesium oxide available as Elastomag 100, Elastomag 100 R, Elastomag 170, Elastomag 170 micropellet; zirconium oxide (SF-EXTRA available from Z-Tech Corporation), colloidal silicas, such as Syloid 74 available from Grace Company (preferably present, in one embodiment, in an amount of from about 10 to about 70 percent by weight percent), amorphous silica available as Flow-Gard CC 120, Flow-Gard CC 140, Flow-Gard CC 160 from PPG Industries, titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80 available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blends of calcium fluoride and silica, such as Opalex-C available from Kemira. O. Y, zinc oxide, such as Zoco Fax 183 available from Zo Chem, blends of zinc sulfide with barium sulfate, such as Lithopane available from Schteben Company, barium titanate, #20, 810-8 available from Aldrich Chemicals, antimony oxide, #23,089-8 available from Aldrich Chemicals, and the like, as well as mixtures thereof. Brightener fluorescent pigments of coumarin derivatives, such as formula #633 available from Polymer Research Corporation of America; fluorescent pigments of oxazole derivatives, such as formula #733 available from Polymer Research Corporation of America; can enhance color mixing and assist in improving print-through in recording sheets of the present invention.

The coatings of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° to about 100° C. in an air dryer.

The drying time of images obtained with the transparencies of the present application is the time for zero image-offset and can be measured as follows: a line comprising different color sequences is drawn on the transparency with droplets of inks from an ink jet printhead moving from left to right and back. Thereafter, this image is purposely smeared with the pinch roll of the printer by fast forwarding the transparency mechanically while the pinch roll is on the top of the imaged line. This entire procedure takes about two seconds to complete. In the event that no offset of the printed image on the unprinted paper or transparency occurs, the drying time of the image is considered as less than two seconds.

Transparencies of the present invention in embodiments exhibit reduced curl upon being printed with aqueous inks, particularly in situations wherein the ink image is dried by exposure to microwave radiation. Generally, the term "curl" refers to the distance between the base line of the arc formed by the transparency or recording sheet when viewed in cross-section across its width (or shorter dimension, for example 8.5 inches in an 8.5×11 inch sheet, as opposed to length, or longer dimension, for example 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The transparencies of the present invention in embodiments exhibit little or no blocking. Blocking refers to the transfer of ink or toner from a printed image from one sheet to another when recording sheets are stacked together. The recording sheets of the present invention exhibit substantially no blocking under, for example, environmental conditions of from about 20 to about 80 percent relative humidity and at temperatures of about 80° F.

Further, the transparencies of the present invention in embodiments exhibit high resistance to humidity. Resistance to humidity generally is the capacity of a recording sheet to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Haze values recited herein were measured by a XL-211 Hazegard Hazemeter supplied by Pacific Scientific Company.

The lightfastness values of the ink jet images were measured in the Mark V Lightfastness Tester obtained from Microscal Company, London, England.

The scrambled block copolymers and graft copolymers of the present application, such as methyl cellulose (MC)-polyacrylamide (PAm) copolymer with a methyl cellulose content of 51.7 percent by weight and a viscosity average molecular weight of $\overline{M}_v=6.0\times10^4$, hydroxypropyl cellulose (HPC)-polyethylene oxide (PEO) copolymer with a hydroxypropyl cellulose content of 52.3 percent by weight and a viscosity average molecular weight of $\overline{M}_v=1.8\times10^5$. Methyl cellulose (MC)-polyacrylic acid (PAA) copolymer with a methyl cellulose content of 53.3 percent by weight and a viscosity average molecular weight of $\overline{M}_v=5.5\times10^4$, hydroxypropyl methylcellulose (HPMC)-polyacrylamide (PAm)-polyvinylalcohol (PVA) terpolymer with a hydroxypropyl methylcellulose content of 33.3 percent by weight, polyacrylamide content of 31.4 percent by weight, polyvinylalcohol content of 35.3 percent by weight, and a viscosity average molecular weight of $\overline{M}_v=8.0\times10^4$ were synthesized using ultrasonic energy. When an ultrasound field is applied to a polymer solution, cavitation results, and a small fraction of energy is used in shearing molecules to yield homolytic cleavage. When this is made to occur in the presence of two homopolymers, the reactions lead to the formation of scrambled block copolymers which would carry segments from both homopolymers. The only requirement for making block copolymers with ultrasonic polymerization is that the two polymers are soluble in a common solvent like water, ethanol, and tetrahydrofuran.

Ultrasonic polymerizations carried out can be accomplished in a batch reactor (25 centimeters long, 16 centimeters diameter >4,000 milliliters capacity) equipped with water jackets to maintain a 2° C. temperature measured with a Ni—Cr alloy probe and a Comark digital thermometer. Prior to subjecting the polymer solutions to ultrasonic treatments, they were purged with nitrogen for a period of 30 minutes. The sealed aluminum reactor was screwed onto a threaded nodal point on disrupter horn (Branson Sonic Power Company of Danbury, Conn., USA with nominal frequency ranging between 20 to 60 kHz) where attachment produces no damping. Ultrasonic intensity ranging between 600 to 4,000 watts was adjusted using the calibration curve of meter reading, power control setting, and power output in watts provided by the manufacturer. After sonicating the polymer solution for the desired period of time, it was transferred to a 10 liter pail and the solvent was removed by distillation. The dried products were subjected to fractionation for the removal of homopolymers by using different solvent/nonsolvent systems. Solvent pairs, such as pyridine/ethanol, were SELECTED for methyl cellulose (MC)-polyacrylic acid (PAA) copolymer synthesis. The block copolymers were characterized for their viscosity average molecular weights, and their composition was calculated using Infrared (IR), and Nuclear Magnetic Resonance Spectroscopy (NMR).

Embodiments of the present invention include a transparency comprised of a supporting substrate, thereover a first coating layer comprised of an anionic polymer, a second cationic coating layer situated on the top of the first anionic layer, and which second layer is comprised of monomeric or polymeric cationic quaternary compounds or mixtures thereof, and which second layer contains a lightfastness inducing agent, and a third ink receiving coating layer situated on the top of the second cationic layer, said third coating layer being comprised of a block polymer, a biocide and a filler, and wherein said transparency possesses a haze value of from about 0.5 to about 10 and a lightfastness value of from about 95 to about 99; a transparency comprised of a supporting substrate, thereover and thereunder a first coating layer comprised of an anionic polymer, and a second cationic layer situated on the top of the first anionic layer and comprised of monomeric or polymeric cationic quaternary compounds and a lightfastness inducing agent, and a third ink receiving layer situated on the top of the second cationic layer and said third layer comprised of a mixture of two block or graft polymers wherein one component is more compatible with fast drying colored inks, and which first component is selected from the group consisting of nonionic polysaccharides and vinyl polymers, and wherein the second component is more compatible with the slow drying black inks and wherein said second component is selected from the group consisting of alkylene oxide polymers, formaldehyde resins, maleic anhydride and maleic acid containing polymers, acrylic polymers, and imine polymers, and wherein said third ink receiving layer contains a biocide and a filler, and which transparency possesses a haze value of from about 0.5 to about 5 and a lightfastness value of about 90 to about 95; a transparency comprised of, in the order stated, a supporting substrate, thereover a first coating layer comprised of an anionic polymer layer, and a second cationic layer situated on the top of the first anionic layer and comprised of cationic alkyl ammonium salts, or alkyl phosphonium quaternary acrylic copolymer latexes and a lightfastness inducing agent; and a third ink receiving layer situated on the top of the second cationic layer and comprised of block copolymer, a biocide and a filler, and which transparency possesses a haze value of from about 0.5 to about 10 and a lightfastness value of from about 95 to about 98; a transparency comprised of a supporting substrate, thereover a first adhesion coating layer comprised of an anionic polymer, and a second cationic layer situated on the top of the first anionic layer, and which cationic layer forms a complex with the anionic layer and which cationic layer is comprised of monomeric or polymeric cationic quaternary compounds and a lightfastness inducing agent, and a third ink receiving layer situated on the top of the second cationic layer and comprised of a block copolymer, a biocide and a filler, and which transparency possesses a haze value of from about 0.5 to about 10 and a lightfastness value of from about 95 to about 98; a transparency comprised of a supporting substrate, thereover and thereunder a first coating layer comprised of an adhesive anionic polymer mixture, present in amounts of from about 25 parts by weight to about 75 parts by weight of one anionic polymer and from about 75 parts by weight to about 25 parts by weight of a second anionic polymer; and a second cationic layer situated on the top of the first anionic layer and comprised of monomeric or polymeric cationic quaternary compounds and mixtures thereof, and a lightfastness inducing agent, and wherein the cationic components or mixtures thereof are present in amounts of from about 80 parts by weight to about 97 parts by weight, the lightfastness inducing components are present in amounts of from about 20 parts by weight to about 3 parts by weight, and a third ink receiving layer situated on the top of the second cationic layer and comprised of block or graft polymers with at least two components, wherein one component is more compatible with the fast drying colored inks and is selected from the group consisting of nonionic polysaccharides, and vinyl polymers, and the second component is more compatible with the slow drying black inks and is selected from the group consisting of alkylene oxide polymers, formaldehyde resins, maleic anhydride and maleic acid containing polymers, acrylic polymers, imine polymers, a biocide and a filler; and a transparency comprised of a supporting substrate, thereover and thereunder a first coating layer comprised of an anionic polymer, a second cationic coating layer situated on the top of the first anionic layer, and which second layer is comprised of monomeric or polymeric cationic quaternary compounds, and which second layer contains a lightfastness inducing agent, and a third ink receiving coating layer situated on the top of the second cationic layer, said third coating layer being comprised of a block polymer, a biocide and a filler.

Specific embodiments of the invention will now be described in detail. These Examples are intended to be illustrative, and the invention is not limited to the materials, conditions, or process parameters set forth in these embodiments. The coatings, a total of six, are included on both surfaces or sides of the transparency unless otherwise indicated. All parts and percentages are by weight unless otherwise indicated.

EXAMPLE I

Syntheses of Scrambled Block Copolymers:

(A) Methyl cellulose (MC)-polyacrylamide (PAm) copolymer, 20.0 grams of MC (number average molecular weight of ($\overline{M}_n$)=$8.6\times10^4$), viscosity (2 percent solution in water) 4,000 centipoise, #27,441-0 obtained from Aldrich Chemicals, and 20.0 grams of PAm ($\overline{M}_w$=$6.0\times10^6$, #001 available from Scientific Polymer Products Incorporated), were dissolved in 3,000 milliliters of water, purged with nitrogen for 30 minutes, and sonicated for 360 minutes at 10° C. Evaporation of solvent yielded a mixture of dry polymers from which 5 grams of methyl cellulose was recovered with pyridine while subsequent washings with lactic acid solution (85 percent by weight) in water yielded 6 grams of polyacrylamide leaving behind 29 grams of scrambled block copolymer of MC-PAm with a methyl cellulose content of 51.7 percent by weight and a viscosity average molecular weight of $\overline{M}_v$=$6.0\times10^4$.

(B) Hydroxypropyl cellulose (HPC)-polyethylene oxide (PEO) copolymer, 20.0 grams of HPC (weight average molecular weight of ($\overline{M}_w$)=$1.0\times10^6$), #404 obtained from Scientific Polymer Products Incorporated, and 20.0 grams of PEO ($\overline{M}_w$=$6.0\times10^6$, #001 available from Scientific Polymer Products Incorporated, were dissolved in 3,000 milliliters of water, purged with nitrogen for 30 minutes, and sonicated for 360 minutes at 10° C. Evaporation of solvent yielded a mixture of dry polymers from which 4.5 grams of PEO was recovered with toluene while subsequent washings with cold (10° C.) tetrahydrofuran yielded 3 grams of HPC leaving behind 32.5 grams of scrambled block copolymer of HPC-PEO with a hydroxypropyl cellulose content of 52.3 percent by weight and a viscosity average molecular weight of $\overline{M}_v$=$1.8\times10^5$.

(C) Methyl cellulose (MC)-polyacrylic acid (PAA) copolymer, 20.0 grams of MC (number average molecular weight ($\overline{M}_n$)=$8.6\times10^4$), viscosity (2 percent solution in water) 4,000 centipoise, #27,441-0 obtained from Aldrich Chemicals, and 20.0 grams of polyacrylic acid (PAA) (weight average molecular weight $\overline{M}_w$=$4.0\times10^6$), #599 available from Scientific Polymer Products Incorporated, were dissolved in 3,000 milliliters of water, purged with nitrogen for 30 minutes, and sonicated for 360 minutes at 10° C. Evaporation of solvent yielded a mixture of dry polymers from which 4 grams of methyl cellulose were recovered with pyridine while subsequent washings with ethanol yielded 6 grams of polyacrylic acid leaving behind 30 grams of scrambled block copolymer of MC-PAA, with a methyl cellulose content of 53.3 percent by weight and a viscosity average molecular weight $\overline{M}_v$=$5.5\times10^4$.

(D) Hydroxypropyl methyl cellulose (HPMC)-polyacrylamide (PAm)-polyvinylalcohol (PVA) terpolymer, 20.0 grams of HPMC (number average molecular weight ($\overline{M}_n$)=$8.6\times10^4$), viscosity (2 percent solution in water) 4,000 centipoise, #423 available from Scientific Polymer Products Incorporated, 20.0 grams of PAm ($\overline{M}_w$=$6.0\times10^6$, #001 available from Scientific Polymer Products Incorporated, and 20.0 grams of polyvinylalcohol (PVA), #334 available from Scientific Polymer Products, were dissolved in 3,000 milliliters of hot water, purged with nitrogen for 30 minutes, and sonicated for 600 minutes at 10° C. Evaporation of solvent yielded a mixture of dry polymers from which 3 grams of HPMC were recovered with methanol while subsequent washings with lactic acid yielded 4 grams of polyacrylamide and further washings with cold water recovered 51 grams of the triblock (HPMC)-(PAm)-(PVA) terpolymer with a hydroxypropyl methyl cellulose content of 33.3 percent by weight, polyacrylamide content of 31.4 percent by weight, polyvinylalcohol content of 35.3 percent by weight, and a viscosity average molecular weight of $\overline{M}_v=8.0\times10^4$, leaving behind 2 grams of polyvinylalcohol.

EXAMPLE II

(COMPARATIVE)

Two hundred feet of two layered transparency structure were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers where the first 5 micron anionic layer in contact with the substrate was comprised of acrylic emulsion Rhoplex TR-934 having a glass transition of minus 30° C., and available from Rhom and Hass Company, present in a concentration of 35 percent by weight in water, and a second 5 micron thick cationic layer situated on the top of the 5 micron thick first layer, and which second layer was comprised of 50 parts by weight of the hydrophilic polymeric Mirapol AZ-1, available from Miranol, Incorporated, 45 parts by weight of the monomeric cationic component tetra methyl ammonium bromide (Aldrich 19,575-8), 3 parts by weight of a lightfastness component comprised of a mixture of the UV absorbing compound poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2 parts by weight of the antioxidant/antiozonant compound 4,4'-methylene-bis(dibutyldithio carbamate), available as Vanlube 7723 from Vanderbilt Corporation, which blend was present in a concentration of 4 percent by weight in water. Subsequent to air drying at 100° C. and monitoring the difference in weight prior to and subsequent to coating, the dried MYLAR™ base sheet rolls contained 1.0 gram in a thickness of 10 microns of the two layered transparency structure. Rewinding the coated side of the MYLAR™ base sheet (roll form) on to an empty core and using these rolls, the uncoated backside side of the MYLAR™ base sheet, were coated on a Faustel Coater using a two slot die simultaneously with the above same two hydrophilic polymeric layers that were coated on the front side. Subsequent to air drying at 100° C. and monitoring the difference in weight prior to and subsequent to coating, the dried MYLAR™ base sheet rolls contained 1.0 gram in a thickness of 10 microns of the two layered transparency structure. This 200 foot two side coated roll was divided in to 7 sections and each section was coated on both sides with a third layer blend comprising 0.1 part by weight of the filler colloidal silica, 4 parts by weight of the cationic biocide poly(oxyethylene (dimethylamino)-ethylene (dimethylamino) ethylene dichloride) (Busan 77, available from Buckman Laboratories Inc.), and 95.9 parts by weight of a homopolymer selected from the group consisting of (1) methyl cellulose (MC) [2 percent by weight in water], (2) hydroxypropyl cellulose (HPC) [15 percent by weight in water], (3) hydroxypropyl methyl cellulose (HPMC) [2 percent by weight in water], (4) polyethylene oxide (PEO) [2 percent by weight in water], (5) polyacrylamide (PAm) [2 percent by weight in water], (6) polyacrylic acid (PAA) [15 percent by weight in water], (7) polyvinylalcohol (PVA) [15 percent by weight in water], using a solvent extrusion process (single side each time initially) on a Faustel Coater using a one slot die in a thickness of 10 microns each. The transparency sheets thus prepared had a haze value of between 0.6 to 1.0.

The above prepared transparencies were printed on a microwave dryer containing Xerox Test Fixture for spot size measurements using inks of the following compositions:

Cyan:

15.75 percent by weight of sulfolane, 12.0 percent by weight of butyl carbitol, 2.0 percent by weight of ammonium bromide, 13.0 percent by weight acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye, obtained from Zenca Colors, 18.75 percent by weight of Projet blue OAM dye, obtained from Zenca Colors, and 15.935 percent by weight of deionized water.

Black:

10.0 percent by weight of sulfolane, 15.0 percent by weight of imidazole, 0.05 percent by weight of DOWICIL 150 biocide obtained from Dow Chemical Company, Midland, Mich., 0.35 percent by weight of polyethylene oxide (molecular weight 18,500) obtained from Union Carbide Company, 25.0 percent by weight of Basacid Black NB X 34 obtained from BASF, and 49.6 percent by weight of deionized water.

The average diameter (spotsize) of ink on the ink receiving layer comprising silica, biocide and homopolymers of methyl cellulose (MC), hydroxypropyl cellulose (HPC), hydroxypropyl methyl cellulose (HPMC), polyethylene oxide (PEO), polyacrylamide (PAm), polyacrylic acid (PAA), polyvinylalcohol (PVA), was found to be 63, 63, 62, 60, 62, 60 and 66 microns for the cyan color, and 64, 61, 63, 62, 65, 65, and 68 microns for the black color. Thus, the spot sizes were lower, and the optical density was lower than when using the transparency of Example III with a block copolymer.

EXAMPLE III

Two hundred feet of two layered transparency structure were prepared in a manner similar to that described in Example II except that the ink receiving layer now contained ultrasonic scrambled block copolymers of Example I. The top ink receiving layer was now comprised of 0.1 part by weight of the colloidal silica, 4 parts by weight of the cationic biocide poly(oxyethylene (dimethylamino)-ethylene (dimethylamino) ethylene dichloride) (Busan 77, available from Buckman Laboratories Inc.), and 95.9 parts by weight of an ultrasonically prepared scrambled copolymer selected from the group consisting of (A) methyl cellulose (MC)-polyacrylamide (PAm) copolymer, (B) hydroxypropyl cellulose (HPC)-polyethylene oxide (PEO) copolymer, methyl cellulose (MC)-polyacrylic acid (PAA) copolymer, (D) hydroxypropyl methyl cellulose (HPMC)-polyacrylamide (PAm)-polyvinylalcohol (PVA) terpolymer in a thickness of 10 microns coated from aqueous solutions present in a concentration of 2 percent by weight in water. These were printed on a microwave dryer containing Xerox Test Fixture for spot size measurements using inks of the following compositions:

15.75 percent by weight of sulfolane, 12.0 percent by weight of butyl carbitol, 2.0 percent by weight of ammonium bromide, 13.0 percent by weight acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye, obtained from Zenca Colors, 18.75 percent by weight of Projet blue OAM dye, obtained from Zenca Colors, and 15.935 percent by weight of deionized water.

Black:

10.0 percent by weight of sulfolane, 15.0 percent by weight of imidazole, 0.05 percent by weight of Dowicil 150 biocide obtained from Dow Chemical Company, Midland, Mich., 0.35 percent by weight of polyethylene oxide (molecular weight 18,500) obtained from Union Carbide Company, 25.0 percent by weight of Basacid Black NB X 34 obtained from BASF, and 49.6 percent by weight of deionized water.

The average diameter (spotsize) of cyan ink on the ink receiving layers comprised of (A) methyl cellulose (MC)-polyacrylamide (PAm) copolymer, 68 microns, (B) hydroxypropyl cellulose (HPC)-polyethylene oxide (PEO) copolymer, 69 microns, (C) methyl cellulose (MC)-polyacrylic acid (PAA) copolymer, 70 microns, (D) hydroxypropyl methyl cellulose (HPMC)-polyacrylamide (PAm)-polyvinylalcohol (PVA) terpolymer, 70 microns, are higher than their respective homopolymers; for example, methyl cellulose (MC)-polyacrylamide (PAm) copolymer has a spot size of 68 microns whereas methyl cellulose homopolymer has a spot size of 63 microns, and polyacrylamide homopolymer has a spot size of 62 microns.

The average diameter (spotsize) of the black ink on the ink receiving layers comprised of (A) methyl cellulose (MC)-polyacrylamide (PAm) copolymer, 70 microns, (B) hydroxypropyl cellulose (HPC)-polyethylene oxide (PEO) copolymer, 67 microns, (C) methyl cellulose (MC)-polyacrylic acid (PAA) copolymer, 72 microns, (D) hydroxypropyl methyl cellulose (HPMC)-polyacrylamide (PAm)-polyvinylalcohol (PVA) terpolymer, 75 microns, are higher than their respective homopolymers; for example, methyl cellulose (MC)-polyacrylamide (PAm) copolymer has a spot size of 70 microns whereas methyl cellulose homopolymer has a spot size of 64 microns and polyacrylamide homopolymer has a spot size of 65 microns, methyl cellulose (MC)-polyacrylamide (PAm) copolymer has a spot size of 70 microns whereas methyl cellulose homopolymer has a spot size of 64 microns and polyacrylamide homopolymer has a spot size of 65 microns.

The haze values of the prepared 4 types of transparencies containing ultrasonically prepared copolymers were about 2 within ±0.05.

EXAMPLE IV

The transparencies of Example III having ink receiving layers comprised of 0.1 part by weight of the colloidal silica, 4 parts by weight of the cationic biocide poly(oxyethylene (dimethylamino)-ethylene (dimethylamino) ethylene dichloride) (Busan 77, available from Buckman Laboratories Inc.), and 95.9 parts by weight of an ultrasonically prepared scrambled copolymer selected from the group consisting of (A) methyl cellulose (MC)-polyacrylamide (PAm) copolymer, (B) hydroxypropyl cellulose (HPC)-polyethylene oxide (PEO) copolymer, (C) methyl cellulose (MC)-polyacrylic acid (PAA) copolymer, (D) hydroxypropyl methyl cellulose (HPMC)-polyacrylamide (PAm)-polyvinylalcohol (PVA) terpolymer, were incorporated into a Hewlett-Packard 500-C color ink jet printer containing inks of the following compositions:

Cyan:

15.75 percent by weight of sulfolane, 12.0 percent by weight of butyl carbitol, 2.0 percent by weight of ammonium bromide, 13.0 percent by weight acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye solution, obtained from Zenca Colors, 18.75 percent by weight of Projet blue OAM dye solution, obtained from Zenca Colors, and 15.935 percent by weight of deionized water.

Magenta:

15.75 percent by weight of sulfolane, 12.0 percent by weight of butyl carbitol, 2.0 percent by weight of ammonium bromide, 13.0 percent by weight acetylethanolamine, 0.03 percent by weight of ammonium hydroxide, 0.05 percent by weight of Dowicil 150 biocide obtained from Dow Chemical Company, Midland, Mich., 0.05 percent by weight of polyethylene oxide (molecular weight 18,500) obtained from Union Carbide Company, 25 percent by weight of Projet Magenta 1T dye solution obtained from Zenca Colors, 6.0 percent by weight of Acid Red 52 solution obtained from Tricon Colors, and 26.12 percent by weight of deionized water.

Yellow:

15.75 percent by weight of sulfolane, 12.0 percent by weight of butyl carbitol,13.0 percent by weight acetylethanolamine, 2.0 percent by weight of ammonium bromide, 0.03 percent by weight of ammonium hydroxide, 0.05 percent by weight of Dowicil 150 biocide obtained from Dow Chemical Company, Midland, Mich., 0.05 percent by weight of polyethylene oxide (molecular weight 18,500) obtained from Union Carbide Company, 27.0 percent by weight of Projet Yellow 1G dye (7.5 percent solution) obtained from Zenca Colors, 20.0 percent by weight of Acid Yellow 17 solution obtained from Tricon Colors, and 10.12 percent by weight of deionized water.

Black:

10.0 percent by weight of sulfolane, 15.0 percent by weight of imidazole, 0.05 percent by weight of Dowicil 150 biocide obtained from Dow Chemical Company, Midland, Mich., 0.35 percent by weight of polyethylene oxide (molecular weight 18,500) obtained from Union Carbide Company, 25.0 percent by weight of Basacid Black NB X 34 obtained from BASF, and 49.6 percent by weight of deionized water Images were generated by printing block patterns for magenta, cyan, yellow, and black. The images thus formed were dried by exposure to microwave radiation with a Citizen Model No. JM55581 obtained from Consumers, Mississauga, Ontario, Canada, set at 700 watts output power at 2450 MHz frequency. The resulting images dried in less than 5 seconds and yielded optical density values of 2.30 black, 1.98 cyan, 1.75 magenta and 1.00 yellow. Due to increased spot sizes of colored and black inks, there were no white streaks in the images. These images had lightfastness values better than 90 percent and, more specifically, about 95 percent average for all colors after a period of six months, and showed no intercolor bleed when retained at an 80 percent humidity at 80° F. for a period of seven days.

In a comparative study, a Hewlett Packard Desk Jet Transparency 51636 F printed with a 550-C printer containing Hewlett Packard inks had a lightfastness value of 17 percent for magenta, 83 percent for yellow, and 4 percent for cyan after 50 hours in a UV fadometer (equivalent to two months of sunshine). The Hewlett Packard Desk Jet Transparency 51636 F with an ink receiving layer of 5 to 6 microns had a haze value of 7 percent. When the ink receiving layer is 10, 15, 20 microns thick, the haze values are substantially higher, that is 10.2, 13.8, and 16.9, respectively. These values were measured from the transmittance data obtained on sandwiches prepared with two, three, and four transparencies.

Other embodiments and modifications of the present invention may occur to those skilled in the art subsequent to a review of the information presented herein; these embodiments and modifications, as well as equivalents thereof, are also included within the scope of this invention.

What is claimed is:

1. A transparency comprised of a supporting substrate, thereover a first coating layer comprised of an anionic polymer, a second cationic coating layer situated on the top of the first anionic layer and which second layer is comprised of monomeric or polymeric cationic quaternary compounds, and which second layer contains a lightfastness inducing agent, and a third ink receiving coating layer situated on the top of the second cationic layer, said third coating layer being comprised of a block polymer, a biocide and a filler, and wherein said transparency possesses a haze value of from about 0.5 to about 10 and a lightfastness value of from about 95 to about 99.

2. A transparency in accordance with claim 1 wherein the anionic polymer of the first layer is selected from the group consisting of (1) rubber latex, (2) polyester latex, (3) vinyl chloride latex, (4) ethylene-vinyl chloride copolymer latex, (5) polyvinyl acetate homopolymer latex, (6) ethylene-vinyl acetate copolymer latex, (7) acrylic-vinyl acetate copolymer latex, (8) vinyl acrylic terpolymer latex, (9) polystyrene latex, (10) styrene-butadiene latex, (11) butadiene-acrylonitrile latex, (12) butadiene-acrylonitrile-styrene terpolymer latex, (13) acrylic emulsion latex, (14) sodium carboxymethyl cellulose, (15) cellulose sulfate salts, wherein the cation thereof is sodium, lithium, potassium, calcium, or magnesium, (16) sodium carboxymethylhydroxyethyl cellulose, and mixtures thereof.

3. A transparency in accordance with claim 1 wherein the thickness of the first coating layer in contact with the substrate is from about 0.1 to about 25 microns.

4. A transparency in accordance with claim 1 wherein the second cationic layer situated on the top of the first anionic layer is comprised of said monomeric or polymeric cationic quaternary compounds selected from the group consisting of (1) dimethylammonium hydrolyzed collagen protein, (2) amino deoxycellulose, (3) diethylammonium chloride hydroxy ethyl cellulose, (4) hydroxypropyl trimethyl ammonium chloride hydroxyethyl cellulose, (5) diethyl amino ethyl cellulose, (6) quaternary acrylic copolymer latexes, (7) tetramethyl ammonium bromide, (8) tetrahexadecyl ammonium bromide, (9) tetraphenyl phosphonium bromide, (10) phenacyl triphenyl phosphonium bromide, and mixtures thereof.

5. A transparency in accordance with claim 1 wherein the lightfastness inducing agent is selected from the group consisting of (1) glycerol ρ-amino benzoate, (2) resorcinol mono benzoate, (3) octyl dimethyl amino benzoate, (4) hexadecyl 3,5-di-tert-butyl-4-hydroxy-benzoate, (5) octyl salicylate, (6) octyl methoxy cinnamate, (7) 4-allyloxy-2-hydroxybenzophenone, (8) 2-hydroxy-4-methoxy benzophenone, (9) 2,2'-dihydroxy-4,4'-dimethoxy benzophenone, (10) 2-hydroxy-4-(octyloxy) benzophenone, (11) 2-hydroxy-4-dodecyloxy benzophenone, (12) 2-(2'-hydroxy-5'-methylphenyl)benzotriazole, (13) 2-[2'-hydroxy-3,5-di-(1,1-dimethyl benzyl)phenyl]-2H-benzotriazole, (14) bis[2-hydroxy-5-tert-octyl-3-(benzotriazol-2-yl) phenyl methane, (15) 2-(3',5'-di-tert-butyl-2'-hydroxyphenyl)-5-chlorobenzotriazole, (16) 2-(4-benzoyl-3-hydroxyphenoxy)ethylacrylate, (17) poly[2-(4-benzoyl-3-hydroxyphenoxy) ethylacrylate], (18) N-(ρ-ethoxycarbonyl phenyl)-N'-ethyl-N'-phenyl formadine, (19) 1,1-(1,2-ethane-diyl) bis(3,3,5,5-tetramethyl piperazinone), (20) tris(3,5-di-tert-butyl-4-hydroxybenzyl)isocyanurate, (21) nickel bis(o-ethyl(3,5-di-tert-butyl-4-hydroxybenzyl) phosphonate, (22) [2,2,6,6-tetramethyl-4-piperidinyl)-1,2,3,4-butane tetracarboxylate, (23) [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, (24) [1,2,2,6,6-pentamethyl-4-piperidinyl/β,β,β',β'-tetramethyl-3,9-(2,4,8, 10-tetraoxospiro (5,5) undecane) diethyl]-1,2,3,4-butane tetracarboxylate, (25) 2-dodecyl-N-(2,2,6,6-tetramethyl-4-piperidinyl) succinimide, (26) 2-dodecyl-N-(1,2,2,6,6-pentamethyl-4-piperidinyl) succinimide, (27) N-(1-acetyl-2,2,6,6-tetramethyl-4-piperidinyl)-2-dodecyl succinimide, (28) tetra sodium N-(1,2-dicarboxyethyl)-N-ocetadecyl sulfosuccinamate, (29) nickel dibutyldithio carbamate, (30) poly(4-hydroxy-2,2,6,6-tetramethyl-1-piperidine ethanol/dimethyl succinic acid), (31) poly(3,5-di-tert-butyl-4-hydroxy hydrocinnamic acid ester/1,3,5-tris(2-hydroxyethyl)-5-triazine-2,4,6(1H,3H,5H)-trione, (32) poly[N,N-bis(2,2,6,6-tetramethyl-4-piperidinyl)-1,6-hexanediamine-co-2,4-dichloro-6-morpholino-1,3,5-triazine), (33) 1-[N-[poly(3-allyloxy-2-hydroxypropyl)-2-aminoethyl]-2-imidazolidinone, (34) poly(2-ethyl-2-oxazoline), and mixtures thereof.

6. A transparency in accordance with claim 1 wherein said filler is selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell, 15 percent by weight, and calcium carbonate, 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconium oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent fillers of coumarin derivatives, (26) fluorescent fillers of oxazole derivatives, (27) antimony oxide; and mixtures thereof.

7. A transparency in accordance with claim 1 wherein the thickness of the third coating layer in contact with the second coating layer is from about 0.1 to about 25 microns.

8. A transparency in accordance with claim 1 wherein the haze value is from about 0.5 to about 5.

9. A transparency in accordance with claim 1 wherein the lightfastness value is from about 95 to about 98 percent.

10. A transparency in accordance with claim 1 wherein the substrate is selected from the group consisting of (1) polyesters, (2) polyethylene naphthalates, (3) polycarbonates, (4) polysulfones, (5) polyether sulfones, (6) poly(arylene sulfones), (7) cellulose triacetate, (8) polyvinyl chloride, (9) cellophane, (10) polyvinyl fluoride, (11) polypropylene, and (12) polyimides.

11. A transparency comprised of a supporting substrate, thereover and thereunder a first coating layer comprised of an anionic polymer, and a second cationic layer situated on the top of the first anionic layer and comprised of monomeric or polymeric cationic quaternary compounds and a lightfastness inducing agent, and a third ink receiving layer situated on the top of the second cationic layer, and said third layer comprised of a mixture of two block or graft polymers wherein one component is more compatible with fast drying colored inks, and which first component is selected from the group consisting of nonionic polysaccharides and vinyl polymers, and wherein the second component is more compatible with the slow drying black inks, and wherein said second component is selected from the group consisting of alkylene oxide polymers, formaldehyde resins, maleic anhydride and maleic acid containing polymers, acrylic polymers, and imine polymers, and wherein said third ink receiving layer contains a biocide and a filler, and which transparency possesses a haze value of from about 0.5 to about 5 and a lightfastness value of about 90 to about 95.

12. A transparency in accordance with claim 11 wherein the thickness of the first anionic coating layer in contact with the substrate is from about 0.1 to about 25 microns.

13. A transparency in accordance with claim 11 wherein the fast drying ink compatible nonionic polysaccharide of the block copolymer is selected from the group consisting of (1) starch, (2) hydroxypropyl starch, (3) hydroxyethyl starch, (4) gelatin, (5) methyl cellulose, (6) benzyl cellulose, (7) phenyl cellulose, (8) hydroxyethyl cellulose, (9) hydroxypropyl cellulose, (10) ethyl hydroxyethyl cellulose, (11) hydroxyethyl methyl cellulose, (12) hydroxypropyl methyl cellulose, (13) hydroxy butylmethyl cellulose, (14) dihydroxypropyl cellulose, (15) hydroxypropyl hydroxyethyl cellulose, (16) chlorodeoxy cellulose, (17) gum arabic, (18) carrageenan, (19) karaya gum, (20) xanthan, (21) chitosan, (22) carboxymethyl hydroxypropyl guar, (23) cationic guar, (24) n-carboxymethyl chitin, (25) agar-agar; and mixtures thereof.

14. A transparency in accordance with claim 11 wherein the fast drying ink compatible nonionic vinyl block copolymer is selected from the group consisting of (1) poly(vinyl alcohol), (2) poly(vinyl phosphate), (3) poly(vinyl pyrrolidone), (4) vinyl pyrrolidone-vinyl acetate copolymers, (5) vinyl pyrrolidone-styrene copolymers, (6) poly(vinylamine), (7) poly(vinyl alcohol) alkoxylated, (8) poly(vinyl pyrrolidone-diethylamino methylmethacrylate); and mixtures thereof.

15. A transparency in accordance with claim 11 wherein the slow drying black ink component is a block copolymer selected from the group consisting of (1) poly(ethylene oxide), (2) ethylene oxide/2-hydroxyethyl methacrylate/ethylene oxide, (3) ethylene oxide/hydroxypropyl methacrylate/ethylene oxide triblock copolymers, (4) ethylene oxide/4-vinyl pyridine/ethylene oxide triblock copolymers, (5) ethylene oxide/isoprene/ethylene oxide triblock copolymers, (6) poly(acrylamide), (7) acrylamide-acrylic acid copolymers, (8) poly(N,N-dimethyl acrylamide), (9) polyacrylic acid, (10) melamine-formaldehyde resin, (11) urea-formaldehyde resin, (12) methylated urea-formaldehyde resins, (13) styrene-maleic anhydride copolymers, (14) vinyl methyl ether-maleic anhydride copolymer, (15) ethylene-maleic anhydride copolymer, (16) butadiene-maleic acid copolymers, (17) vinylmethylether-maleic acid copolymer, (18) methyl vinyl ether-maleic acid ester, (19) poly(ethylene imine), (20) poly(ethylene imine) epichlorohydrin, (21) ethoxylated poly (ethylene imine); and mixtures thereof.

16. A transparency comprised of, in the order stated, a supporting substrate, thereover a first coating layer comprised of an anionic polymer layer, and a second cationic layer situated on the top of the first anionic layer and comprised of cationic alkyl ammonium salts, or alkyl phosphonium quaternary acrylic copolymer latexes and a lightfastness inducing agent; and a third ink receiving layer situated on the top of the second cationic layer and comprised of block copolymer, a biocide and a filler, and which transparency possesses a haze value of from about 0.5 to about 10 and a lightfastness value of from about 95 to about 98.

17. A transparency in accordance with claim 16 wherein the first anionic layer binder polymer is an acrylic emulsion latex, a styrene-butadiene latex, cellulose sulfate salts; the second cationic layer materials are tetramethyl ammonium bromide, tetraphenyl phosphonium bromide, quaternary acrylic copolymer latexes; and the lightfastness agents are 2-hydroxy-4-dodecyloxy benzophenone, poly[N,N-bis(2,2,6,6-tetramethyl-4-piperidinyl)-1,6-hexanediamine-co-2,4-dichloro-6-morpholino-1,3,5-triazine), [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate; the ink receiving ultrasonic block/graft copolymers are methyl cellulose (MC)-polyacrylamide (PAm) copolymer, hydroxypropyl cellulose (HPC)-polyethylene oxide (PEO) copolymer, hydroxypropyl methyl cellulose (HPMC)-polyacrylamide polyvinylalcohol (PVA) terpolymer; the filler is colloidal silica, or hollow composite microspheres of polyvinylidene chloride/acrylonitrile copolymers; and the biocide is a cationic poly (oxyethylene (dimethylamino)-ethylene (dimethylamino) ethylene dichloride), anionic potassium N-hydroxymethyl-N-methyl-dithiocarbamate.

18. A transparency in accordance with claim 17 wherein the first anionic layer binder polymer is comprised of a mixture of two polymers present in amounts of from about 25 parts by weight to about 75 parts by weight of the first polymer, and from about 75 parts by weight to about 25 parts by weight of the second polymer, said cationic is present in amounts of from about 80 parts by weight to about 97 parts by weight and the lightfastness inducing components are present in amounts of from about 20 parts by weight to about 3 parts by weight, and said third coating composition; the block copolymer component is present in amounts of from about 90 parts by weight to about 98.9 parts by weight; the filler is present in amounts of from about 5 parts by weight to about 1 part by weight; and the biocide is present in amounts of from about 5 parts by weight to about 0.1 part by weight, although the amounts can be outside of this range.

19. A transparency comprised of a supporting substrate, thereover a first adhesion coating layer comprised of an anionic polymer and a second cationic layer situated on the top of the first anionic layer, and which cationic layer forms a complex with the anionic layer, and which cationic layer is comprised of monomeric or polymeric cationic quaternary compounds and a lightfastness inducing agent, and a third ink receiving layer situated on the top of the second cationic layer and comprised of a block copolymer, a biocide and a filler, and which transparency possesses a haze value of from about 0.5 to about 10 and a lightfastness value of from about 95 to about 98.

20. A transparency comprised of a supporting substrate, thereover and thereunder a first coating layer comprised of an adhesive anionic polymer mixture present in amounts of from about 25 parts by weight to about 75 parts by weight of one anionic polymer and from about 75 parts by weight to about 25 parts by weight of a second anionic polymer; and a second cationic layer situated on the top of the first anionic layer and comprised of monomeric or polymeric cationic quaternary compounds and mixtures thereof, and a lightfastness inducing agent, and wherein the cationic components or mixtures thereof are present in amounts of from about 80 parts by weight to about 97 parts by weight, the lightfastness inducing components are present in amounts of from about 20 parts by weight to about 3 parts by weight, and a third ink receiving layer situated on the top of the second cationic layer and comprised of block or graft polymers with at least two components, wherein one component is more compatible with the fast drying colored inks and is selected from the group consisting of nonionic polysaccharides and vinyl polymers, and the second component is more compatible with the slow drying black inks and is selected from the group consisting of alkylene oxide polymers, formaldehyde resins, maleic anhydride and maleic acid containing polymers, acrylic polymers, imine polymers, a biocide and a filler.

21. A transparency comprised of a supporting substrate, thereover and thereunder a first coating layer comprised of an anionic polymer, a second cationic coating layer situated on the top of the first anionic layer, and which second layer is comprised of monomeric or polymeric cationic quaternary compounds, and which second layer contains a lightfastness inducing agent, and a third ink receiving coating layer situated on the top of the second cationic layer, said third coating layer being comprised of a block polymer, a biocide and a filler.

* * * * *